US011417254B2

(12) United States Patent
Kim et al.

(10) Patent No.: US 11,417,254 B2
(45) Date of Patent: Aug. 16, 2022

(54) FOLDABLE DISPLAY APPARATUS AND METHOD OF DRIVING THE SAME

(71) Applicant: Samsung Display Co., Ltd., Yongin-si (KR)

(72) Inventors: Taehoon Kim, Hwaseong-si (KR); Wontae Kim, Hwaseong-si (KR); Jihye Kim, Hwaseong-si (KR); Jae-Hyeon Jeon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/929,733

(22) Filed: Jul. 15, 2020

(65) Prior Publication Data

US 2021/0020087 A1 Jan. 21, 2021

(30) Foreign Application Priority Data

Jul. 16, 2019 (KR) ..... 10-2019-0085985
Jul. 3, 2020 (KR) ..... 10-2020-0082242

(51) Int. Cl.
*G09G 3/00* (2006.01)

(52) U.S. Cl.
CPC ..... *G09G 3/035* (2020.08); *G09G 2310/0221* (2013.01); *G09G 2310/0267* (2013.01); *G09G 2310/0275* (2013.01); *G09G 2310/0291* (2013.01); *G09G 2330/022* (2013.01); *G09G 2330/023* (2013.01); *G09G 2380/02* (2013.01)

(58) Field of Classification Search
CPC ... G09G 2310/0221; G09G 2310/0267; G09G 2310/0275; G09G 2310/0291; G09G 2330/022; G09G 2330/023; G09G 2380/02; G09G 3/035; G09G 3/3233; G09G 3/3241; G09G 5/003; G09G 3/3258; G09G 3/3266; G09G 3/3255; G09G 3/3291; G09G 3/325; G06N 3/0454; G06F 1/1679; G06F 3/147; G06F 1/169; G06F 1/1677; G09F 9/301; G05D 3/10

See application file for complete search history.

(56) References Cited

U.S. PATENT DOCUMENTS 9,830,855 B1 * 11/2017 Li ..... G06F 1/1652
2004/0207578 A1 * 10/2004 Koyama ..... G09G 3/3241 345/76
2010/0039458 A1 * 2/2010 Nathan ..... G09G 3/3291 345/698
2011/0241998 A1 * 10/2011 McKinney ..... G06F 1/169 345/168

(Continued)

FOREIGN PATENT DOCUMENTS

KR 10-0717278 B1 5/2007
KR 10-2010-0077325 A 7/2010

(Continued)

*Primary Examiner* — Richard J Hong
(74) *Attorney, Agent, or Firm* — Lewis Roca Rothgerber Christie LLP

(57) ABSTRACT

A display apparatus includes: a foldable display panel to display an image; a gate driver to output a gate signal to the foldable display panel; and a data driver to output a data voltage to the foldable display panel according to a driving current. The driving current is changed according to a display mode that corresponds to a folded state of the foldable display panel.

26 Claims, 29 Drawing Sheets

(56) References Cited

U.S. PATENT DOCUMENTS

| | | | | |
|---|---|---|---|---|
| 2013/0334979 | A1* | 12/2013 | Nathan | G09G 3/325 315/240 |
| 2015/0022515 | A1* | 1/2015 | Ikeda | G09G 3/3233 345/212 |
| 2015/0022561 | A1* | 1/2015 | Ikeda | G09F 9/301 345/690 |
| 2016/0320804 | A1* | 11/2016 | Takayanagi | G06F 1/1679 |
| 2016/0321969 | A1* | 11/2016 | Kambhatla | G09G 5/003 |
| 2017/0345365 | A1* | 11/2017 | Li | G09G 3/035 |
| 2018/0211620 | A1* | 7/2018 | Kurokawa | G06N 3/0454 |
| 2019/0197960 | A1* | 6/2019 | Kim | G05D 3/10 |
| 2020/0152109 | A1* | 5/2020 | Jung | G06F 3/147 |
| 2020/0202774 | A1* | 6/2020 | Cho | G06F 1/1677 |
| 2020/0394984 | A1* | 12/2020 | Park | G09G 3/3266 |

FOREIGN PATENT DOCUMENTS

| | | | |
|---|---|---|---|
| KR | 10-2016-0136642 | A | 11/2016 |
| KR | 10-1808529 | B1 | 12/2017 |

* cited by examiner

FOLDABLE DISPLAY APPARATUS AND METHOD OF DRIVING THE SAME

CROSS-REFERENCE TO RELATED APPLICATION

This application claims priority to and the benefit of Korean Patent Application No. 10-2019-0085985, filed on Jul. 16, 2019, and Korean Patent Application No. 10-2020-0082242, filed on Jul. 3, 2020, in the Korean Intellectual Property Office KIPO, the contents of which are herein incorporated by reference in their entireties.

BACKGROUND

1. Field

Aspects of one or more exemplary embodiments of the present inventive concept relate to a display apparatus and a method of driving the display apparatus. More particularly, aspects of one or more exemplary embodiments of the present inventive concept relate to a foldable display apparatus and a method of driving the display apparatus.

2. Description of the Related Art

Generally, a display apparatus includes a display panel and a display panel driver. The display panel includes a plurality of gate lines, a plurality of data lines, a plurality of emission lines, and a plurality of pixels. The display panel driver includes a gate driver, a data driver, an emission driver, and a driving controller. The gate driver outputs gate signals to the gate lines. The data driver outputs data voltages to the data lines. The emission driver outputs emission signals to the emission lines. The driving controller controls the gate driver, the data driver, and the emission driver.

A foldable display apparatus has been developed using a maximized flexible characteristic of a flexible display panel. The foldable display apparatus may have at least two display areas. The display areas may be formed in a single flexible display panel.

A display area from among the display areas may be in an inactive area according to a folded state (or status) of the display apparatus. A black image may be displayed on the inactive area. Although the black image is displayed on the inactive area, some amount of power may be consumed.

The above information disclosed in this Background section is for enhancement of understanding of the background of the inventive concept, and therefore, it may contain information that does not constitute prior art.

SUMMARY

One or more exemplary embodiments of the present inventive concept are directed to a display apparatus capable of reducing a power consumption of the display apparatus.

One or more exemplary embodiments of the present inventive concept are directed to a method of driving the display apparatus.

According to an exemplary embodiment of the present inventive concept, a display apparatus includes: a foldable display panel configured to display an image; a gate driver configured to output a gate signal to the foldable display panel; and a data driver configured to output a data voltage to the foldable display panel according to a driving current, the driving current to change according to a display mode that corresponds to a folded state of the foldable display panel.

In an exemplary embodiment, the display mode may include a normal display mode and a partial display mode; the driving current may include a first driving current and a second driving current; the data driver may be configured to be driven by the first driving current in the normal display mode to display the image on an entirety of a display area of the foldable display panel when operating in the normal display mode; the data driver may be configured to be driven by the second driving current in the partial display mode to display the image on a portion of the display area of the foldable display panel when operating in the partial display mode; and the first driving current may be greater than the second driving current.

In an exemplary embodiment, the data driver may include a plurality of output buffers configured to output the data voltage to a plurality of data lines of the foldable display panel, and the driving current of the data driver may correspond to a driving current of the output buffers.

In an exemplary embodiment, the data driver may include a current mirror circuit connected to each of the output buffers, the current mirror circuit including: a first current source; a first switch connected to the first current source in series; a second current source; and a second switch connected to the second current source in series. Each of the first switch and the second switch may be configured to be turned on in the normal display mode, and the first switch may be configured to be turned off and the second switch may be configured to be turned on in the partial display mode.

In an exemplary embodiment, the driving current of the data driver may be determined according to an active line that may be farthest from the data driver at an active display area of the foldable display panel where the image is to be displayed.

In an exemplary embodiment, the foldable display panel may include a first display area and a second display area; the first display area may be closer to the data driver than the second display area; the driving current may include a first driving current and a second driving current; the data driver may be configured to be driven by the first driving current when each of the first display area and the second display area is in an active state; the data driver may be configured to be driven by the second driving current when the first display area is in an active state and the second display area is in an inactive state; and the first driving current may be greater than the second driving current.

In an exemplary embodiment, the data driver may include a current mirror circuit connected to each of a plurality of output buffers, the current mirror circuit including: a first current source; a first switch connected to the first current source in series; a second current source; and a second switch connected to the second current source in series. Each of the first switch and the second switch may be configured to be turned on when each of the first display area and the second display area is in an active state, and the first switch may be configured to be turned off and the second switch may be configured to be turned on when the first display area is in an active state and the second display area is in an inactive state.

In an exemplary embodiment, a data voltage that may be transmitted to a last active line of the second display area may have a first slew rate when each of the first display area and the second display area is in an active state, a data voltage that may be transmitted to a last active line of the first display area may have a second slew rate when the first display area is in an active state and the second display area is in an inactive state, and the first slew rate may be substantially the same as the second slew rate.

In an exemplary embodiment, the foldable display panel may include a first display area and a second display area; the first display area may be closer to the data driver than the second display area; the driving current may include a first driving current and a third driving current; the data driver may be configured to be driven by the first driving current when each of the first display area and the second display area is in an active state; the data driver may be configured to be driven by the third driving current when the first display area is in an inactive state and the second display area is in an active state; and the first driving current may be substantially equal to the third driving current.

In an exemplary embodiment, the foldable display panel may include a first display area, a second display area, and a third display area; the first display area may be closer to the data driver than the second display area; the second display area may be closer to the data driver than the third display area; the driving current may include a first driving current and a second driving current; the data driver may be configured to be driven by the first driving current when each of the first display area, the second display area, and the third display area is in an active state; the data driver may be configured to be driven by the second driving current when each of the first display area and the second display area is in an active state, and the third display area is in an inactive state; and the first driving current may be greater than the second driving current.

In an exemplary embodiment, the data driver may include a current mirror circuit connected to each of a plurality of output buffers, the current mirror circuit including: a first current source; a first switch connected to the first current source in series; a second current source; a second switch connected to the second current source in series; a third current source; and a third switch connected to the third current source in series. Each of the first switch, the second switch, and the third switch may be configured to be turned on when each of the first display area, the second display area, and the third display area is in an active state; and the first switch may be configured to be turned off and each of the second switch and the third switch may be configured to be turned on when each of the first display area and the second display area is in an active state, and the third display area is in an inactive state.

In an exemplary embodiment, a data voltage that may be transmitted to a last active line of the third display area may have a first slew rate when each of the first display area, the second display area, and the third display area is in an active state; a data voltage that may be transmitted to a last active line of the second display area may have a second slew rate when each of the first display area and the second display area is in an active state, and the third display area is in an inactive state; and the first slew rate may be substantially the same as the second slew rate.

In an exemplary embodiment, the driving current may further include a third driving current; the data driver may be configured to be driven by the third driving current when the first display area is in an active state, and each of the second display area and the third display area is in an inactive state; and the second driving current may be greater than the third driving current.

In an exemplary embodiment, the data driver may include a current mirror circuit connected to each of a plurality of output buffers, the current mirror circuit including: a first current source; a first switch connected to the first current source in series; a second current source; a second switch connected to the second current source in series; a third current source; and a third switch connected to the third current source in series. Each of the first switch and the second switch may be configured to be turned off and the third switch may be configured to be turned on when the first display area is in an active state and each of the second display area and the third display area is in an inactive state.

In an exemplary embodiment, a data voltage that may be transmitted to a last active line of the third display area may have a first slew rate when each of the first display area, the second display area, and the third display area is in an active state; a data voltage that may be transmitted to a last active line of the first display area may have a third slew rate when the first display area is in an active state and each of the second display area and the third display area is in an inactive state; and the first slew rate may be substantially the same as the third slew rate.

According to an exemplary embodiment of the present inventive concept, a method of driving a display apparatus, includes: outputting a gate signal to a foldable display panel; adjusting a driving current of a data driver according to a display mode, the display mode corresponding to a folded state of the foldable display panel; and outputting a data voltage to the foldable display panel according to the driving current of the data driver.

In an exemplary embodiment, the display mode may include a normal display mode and a partial display mode; the driving current may include a first driving current and a second driving current; the data driver may be configured to be driven by the first driving current in the normal display mode to display an image on an entirety of a display area of the foldable display panel when operating in the normal display mode; the data driver may be configured to be driven by the second driving current in the partial display mode to display the image on a portion of the display area of the foldable display panel when operating in the partial display mode; and the first driving current may be greater than the second driving current.

In an exemplary embodiment, the data driver may include a plurality of output buffers configured to output the data voltage to a plurality of data lines of the foldable display panel, and the driving current of the data driver may correspond to a driving current of the output buffers.

In an exemplary embodiment, the data driver may include a current mirror circuit connected to each of the output buffers, the current mirror circuit including: a first current source; a first switch connected to the first current source in series; a second current source; and a second switch connected to the second current source in series. Each of the first switch and the second switch may be configured to be turned on when in the normal display mode, and the first switch may be configured to be turned off and the second switch may be configured to be turned on when in the partial display mode.

In an exemplary embodiment, the driving current of the data driver may be determined according to an active line that may be farthest from the data driver at an active display area of the foldable display panel where an image is displayed.

According to an exemplary embodiment of the present inventive concept, a display apparatus includes: a display panel configured to display an image; a gate driver configured to output a gate signal to the display panel; and a data driver configured to output a data voltage to the display panel according to a driving current, the driving current to change according to a size of an active display area of the display panel.

In an exemplary embodiment, the display panel may be a foldable display panel. The size of the active display area may decrease when the display panel is folded along a folding line. The size of the active display area may increase when the display panel is unfolded.

In an exemplary embodiment, the display panel may be a rollable display panel. The size of the active display area may decrease when the display panel is wound around an axis. The size of the active display area may increase when the display panel is unwound from the axis.

In an exemplary embodiment, the display panel may be a slide display panel. The size of the active display area may increase when the display panel is pulled in a sliding direction. The size of the active display area may decrease when the display panel is pushed in a direction opposite to the sliding direction.

In an exemplary embodiment, when the size of the active display area increases, a slew rate of the driving current may increase.

In an exemplary embodiment, the data driver may include a plurality of output buffers configured to output data voltages to corresponding data lines of the display panel. The driving current of the data driver may correspond to a driving current of the output buffers. The data driver may include a current mirror circuit commonly connected to the output buffers. The current mirror circuit may include a current source and a variable resistance connected to the current mirror circuit in series. When the size of the active display area increases, the variable resistance may decrease.

In an exemplary embodiment, when the size of the active display area increases, the driving current may increase.

In an exemplary embodiment, the data driver may include a plurality of output buffers configured to output data voltages to corresponding data lines of the display panel. The driving current of the data driver may correspond to a driving current of the output buffers. The data driver may include a current mirror circuit commonly connected to the output buffers. The current mirror circuit may include a plurality of current sources and a plurality of switches respectively connected to the current sources in series. When the size of the active display area increases, the number of turned on switches among the plurality of switches may increase.

According to one or more exemplary embodiments of the display apparatus and the method of driving the display apparatus, the data driver is driven using different driving currents in a normal display mode and in a partial driving mode so that power consumption of the data driver in the partial driving mode may be reduced. For example, the driving current of the data driver may be changed (e.g., or adjusted) based on a position of a last horizontal line that is the farthest from the data driver in the active display area where the image is displayed so that power consumption of the data driver may be reduced.

In addition, the data driver is driven using different driving currents according to a size of the display area of the rollable display apparatus so that power consumption of the data driver may be reduced.

In addition, the data driver is driven using different driving currents according to a size of the display area of the slide display apparatus so that power consumption of the data driver may be reduced.

BRIEF DESCRIPTION OF THE DRAWINGS

The above and other aspects and features of the present inventive concept will become more apparent to those skilled in the art from the following detailed description of the exemplary embodiments with reference to the accompanying drawings, in which.

DETAILED DESCRIPTION

Figure 1:
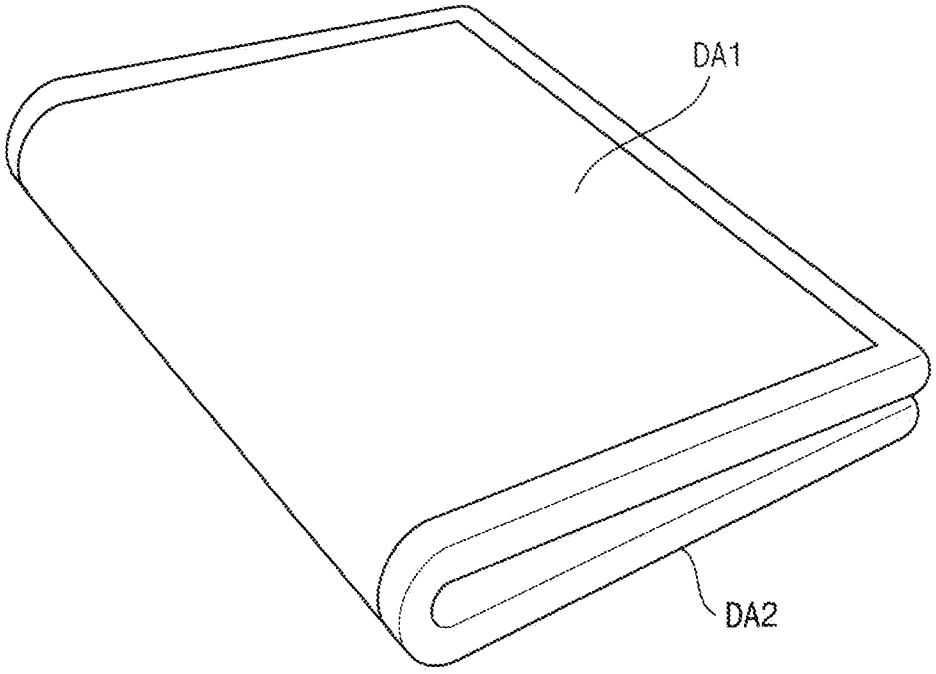
FIG. 1 is a perspective view illustrating a display apparatus according to an exemplary embodiment of the present inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept."

As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
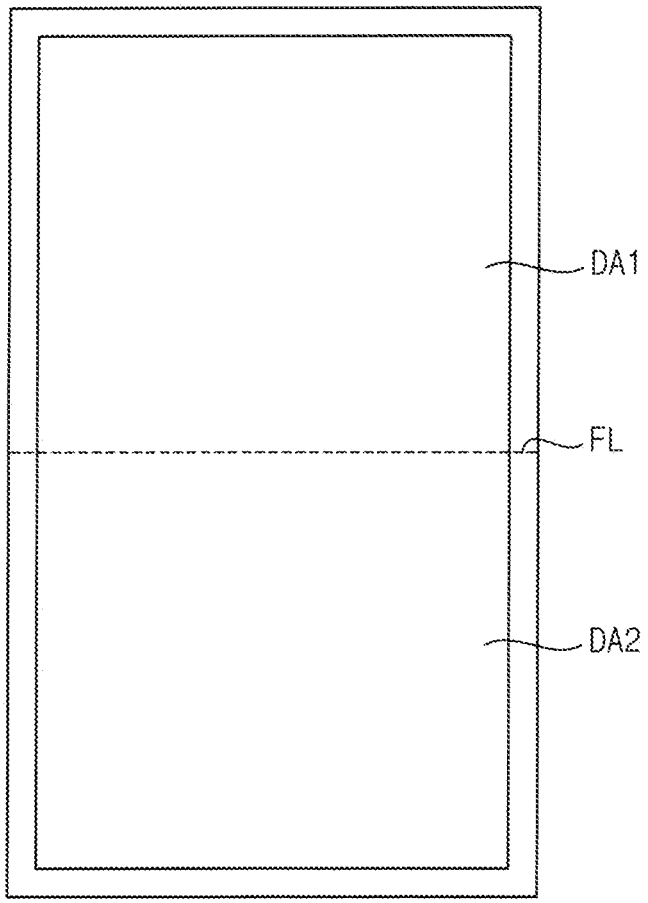
FIG. 2 is a plan view illustrating the display apparatus of FIG. 1.

FIG. 1 is a perspective view illustrating a display apparatus according to an exemplary embodiment of the present inventive concept. FIG. 2 is a plan view (e.g., a view from a plane that is parallel to or substantially parallel to a top surface of the display apparatus) illustrating the display apparatus of FIG. 1.

Referring to FIGS. 1 and 2, the display apparatus may include a flexible display panel. The display apparatus may be a foldable display apparatus. The display apparatus may be folded along a folding line FL.

The display apparatus may include a first display area DA1 disposed at (e.g., in or on) a first side (or a first area) of the display apparatus relative to the folding line FL, and a second display area DA2 disposed at (e.g., in or on) a second side (or a second area) of the display apparatus relative to the folding line FL.

In some embodiments, when the display apparatus is folded as shown in FIG. 1, the first display area DA1 may display an image and the second display area DA2 may not display an image. In other embodiments, when the display apparatus is folded as shown in FIG. 1, the second display area DA2 may display an image and the first display area DA1 may not display an image. However, the present inventive concept is not limited thereto, for example, in an embodiment, the displaying of the image on the first display area DA1 and/or the second display area DA2 according to the folding of the display apparatus may be configured (e.g., set) according to (e.g., depending on or based on) a user setting.

Figure 3:
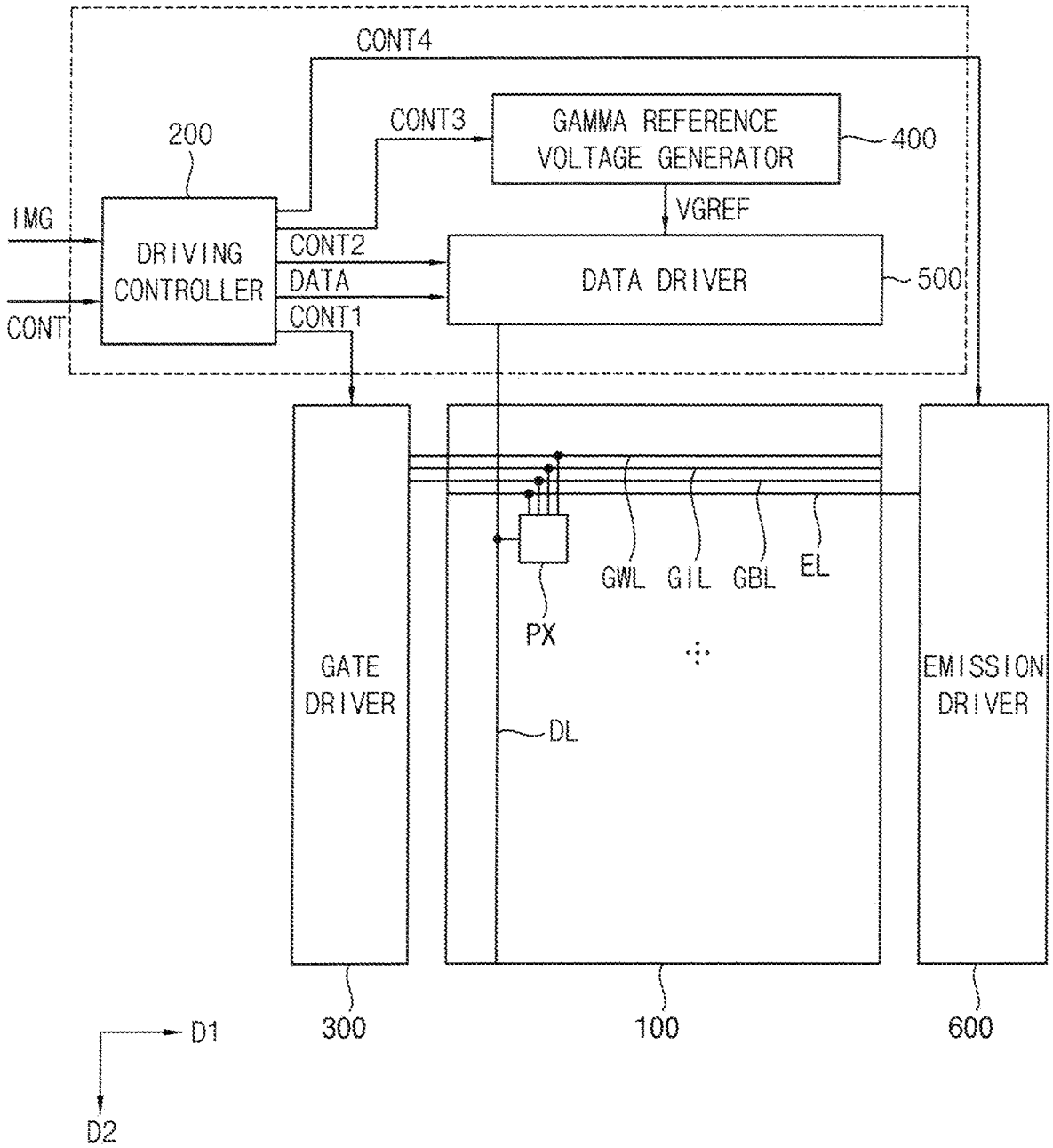
FIG. 3 is a block diagram illustrating the display apparatus of FIG. 1.

FIG. 3 is a block diagram illustrating the display apparatus of FIG. 1.

Referring to FIGS. 1 to 3, the display apparatus includes a display panel 100 and a display panel driver. The display panel driver includes a driving controller 200, a gate driver 300, a gamma reference voltage generator 400, a data driver 500, and an emission driver 600.

The display panel 100 may be a flexible display panel. The display panel 100 may be a foldable display panel.

The display panel 100 includes a plurality of gate lines GWL, GIL, and GBL, a plurality of data lines DL, a plurality of emission lines EL, and a plurality of pixels PX electrically connected to the gate lines GWL, GIL, and GBL, the data lines DL, and the emission lines EL. Each of the gate lines GWL, GIL, and GBL and emission lines EL may extend in a first direction D1, and each of the data lines DL may extend in a second direction D2 crossing the first direction D1. Each of the pixels PX may be disposed at crossing areas of the gate lines GWL, GIL, and GBL, the emission lines EL, and the data lines DL.

The driving controller 200 receives input image data IMG and an input control signal CONT from an external apparatus (e.g., a host device). For example, in some embodiments, the input image data IMG may include red image data, green image data, and blue image data. In some embodiments, the input image data IMG may include white image data. In some embodiments, the input image data IMG may include magenta image data, cyan image data, and yellow image data. However, the present inventive concept is not limited to the kinds of image data IMG described above, and the image data IMG may include any suitable image data as would be known to those skilled in the art. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA according to (e.g., based on) the input image data IMG and the input control signal CONT.

The driving controller 200 generates the first control signal CONT1 for controlling an operation of the gate driver 300 according to (e.g., based on) the input control signal CONT, and outputs the first control signal CONT1 to the gate driver 300. For example, the first control signal CONT1 may include a vertical start signal and a gate clock signal.

The driving controller 200 generates the second control signal CONT2 for controlling an operation of the data driver 500 according to (e.g., based on) the input control signal CONT, and outputs the second control signal CONT2 to the data driver 500. For example, the second control signal CONT2 may include a horizontal start signal and a load signal.

The driving controller 200 generates the data signal DATA according to (e.g., based on) the input image data IMG. The driving controller 200 outputs the data signal DATA to the data driver 500.

The driving controller 200 generates the third control signal CONT3 for controlling an operation of the gamma reference voltage generator 400 according to (e.g., based on) the input control signal CONT. The driving controller 200 outputs the third control signal CONT3 to the gamma reference voltage generator 400.

The driving controller 200 generates the fourth control signal CONT4 for controlling an operation of the emission driver 600 according to (e.g., based on) the input control signal CONT. The driving controller 200 outputs the fourth control signal CONT4 to the emission driver 600.

The gate driver 300 generates gate signals for driving the gate lines GWL, GIL, and GBL in response to the first control signal CONT1 that is received from the driving controller 200. The gate driver 300 may output (e.g., sequentially output) the gate signals to the gate lines GWL, GIL, and GBL. In some embodiments, the gate driver 300 may be integrated on (e.g., integrally formed with) the display panel 100. In other embodiments, the gate driver 300 may be connected to (e.g., mounted on) the display panel 100.

The gamma reference voltage generator 400 generates a gamma reference voltage VGREF in response to the third control signal CONT3 that is received from the driving controller 200. The gamma reference voltage generator 400 provides the gamma reference voltage VGREF to the data driver 500. The gamma reference voltage VGREF has a value corresponding to a level of the data signal DATA.

While FIG. 3 shows that the gamma reference voltage generator 400 is a separate display panel driver of the display apparatus, the present inventive concept is not limited thereto, and in other embodiments, the gamma reference voltage generator 400 may be disposed at (e.g., in or on) the driving controller 200, or at (e.g., in or on) the data driver 500. For example, in various exemplary embodiments, the gamma reference voltage generator 400 may be a part of the driving controller 200 or a part of the data driver 500, but the present inventive concept is not limited thereto.

The data driver 500 receives the second control signal CONT2 and the data signal DATA from the driving controller 200, and receives the gamma reference voltages VGREF from the gamma reference voltage generator 400. The data driver 500 converts the data signal DATA into corresponding data voltages (e.g., data voltages having an analog type) using the gamma reference voltages VGREF. The data driver 500 outputs the data voltages to the data lines DL.

The emission driver 600 generates emission signals to drive the emission lines EL in response to the fourth control signal CONT4 that is received from the driving controller 200. The emission driver 600 may output the emission signals to the emission lines EL.

In an exemplary embodiment, the driving controller 200 and the data driver 500 may be formed (e.g., integrally formed) as a single driving chip. In an exemplary embodiment, the driving controller 200, the gamma reference voltage generator 400, and the data driver 500 may be formed (e.g., integrally formed) as a single driving chip.

In an exemplary embodiment, the driving controller 200, the gamma reference voltage generator 400, the data driver 500, and the emission driver 600 may be formed (e.g., integrally formed) as a single driving chip.

Figure 4:
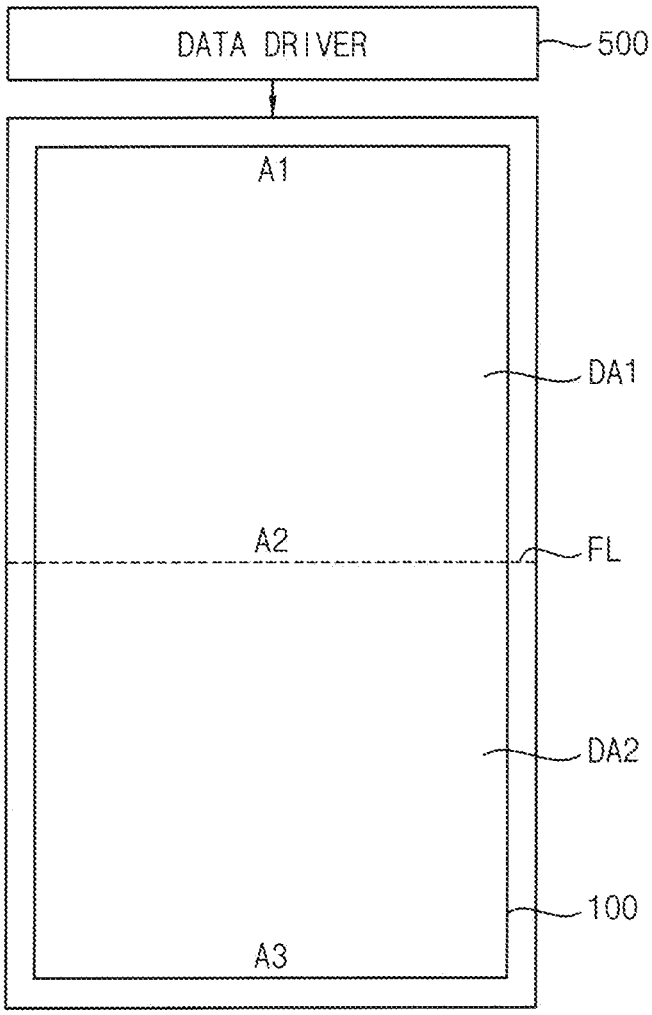
FIG. 4 is a conceptual diagram illustrating a display panel and a data driver of FIG. 1 in a first display mode.
Figure 5:
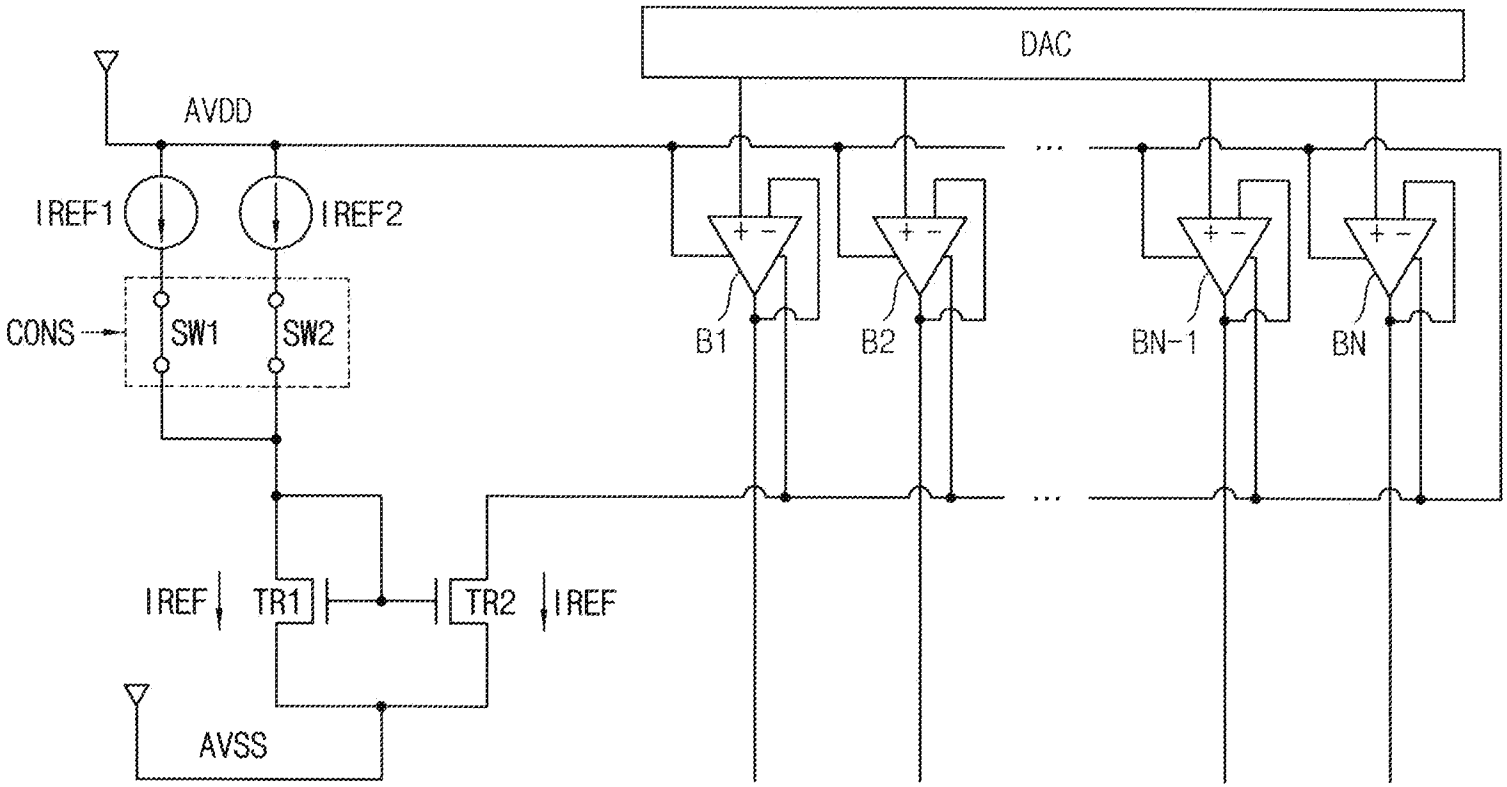
FIG. 5 is a circuit diagram illustrating the data driver of FIG. 1 in the first display mode.
Figure 6:
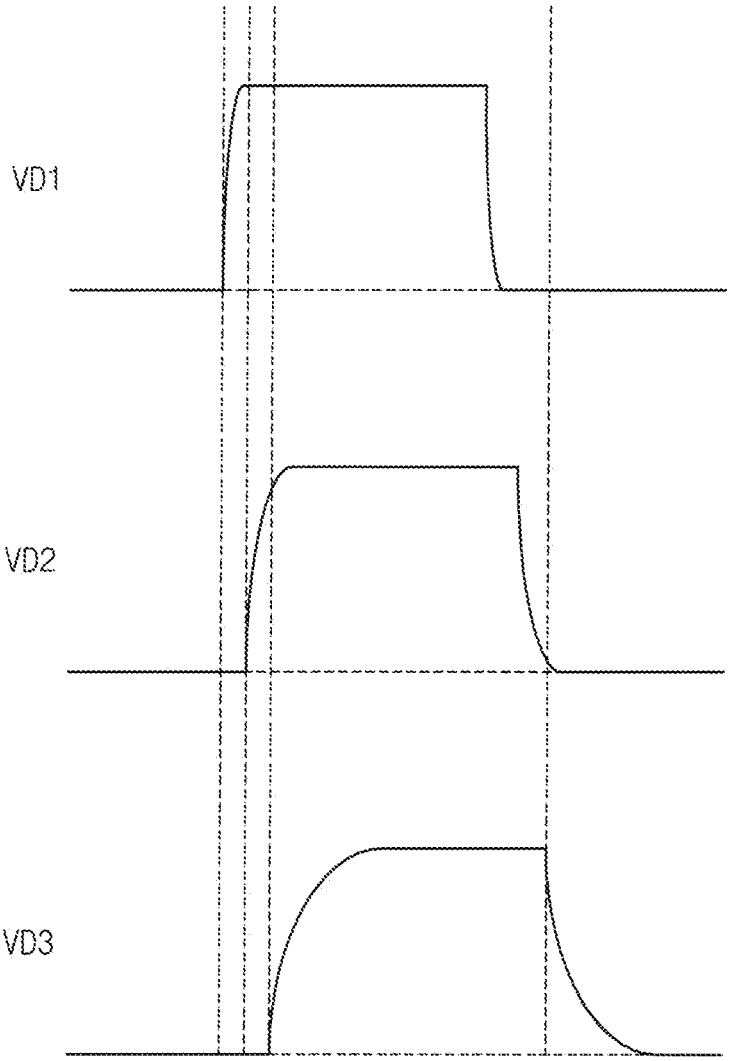
FIG. 6 is a waveform diagram illustrating a data voltage output to the data driver of FIG. 1 in the first display mode.

FIG. 4 is a conceptual diagram illustrating the display panel 100 and the data driver 500 of FIG. 1 in a first display mode. FIG. 5 is a circuit diagram illustrating the data driver 500 of FIG. 1 in the first display mode. FIG. 6 is a waveform diagram illustrating a data voltage output to the data driver 500 of FIG. 1 in the first display mode.

Referring to FIGS. 1 to 6, a display mode of the foldable display panel 100 may be determined by a folded status (or a folded state) of the foldable display panel 100. For example, the display mode may include a normal display mode (e.g., a first display mode) and a partial display mode (e.g., a second display mode). In the normal display mode, an image is displayed on an entire display area (e.g., on each of the first display area DA1 and the second display area DA2) of the foldable display panel 100. In the partial display mode, an image is displayed on a part of the display area (e.g., on one of the first or second display areas DA1 or DA2) of the foldable display panel 100. For example, when the foldable display panel 100 is folded, the foldable display panel 100 may operate in the partial display mode (e.g., the second mode). In another example, when the foldable display panel 100 is unfolded (or in an unfolded state), the foldable display panel 100 may operate in the normal display mode (e.g., the first mode).

A driving current of the data driver 500 may be varied according to the display mode. For example, when the display mode is the normal display mode, the data driver 500 may be driven according to a first driving current. In another example, when the display mode is the partial display mode, the data driver 500 may be driven according to a second driving current. The first driving current may be greater than the second driving current.

In FIG. 4, the foldable display panel 100 may include the first display area DA1 and the second display area DA2. The first display area DA1 may be closer to the data driver 500 than the second display area DA2. For example, the first display area DA1 may be disposed between the data driver 500 and the second display area DA2, such that the first display area DA1 is more adjacent (e.g., closer) to the data driver 500 than the second display area DA2.

In FIG. 4, both of the first display area DA1 and the second display area DA2 may be activated (e.g., be in an active state). For example, in FIG. 4, the foldable display panel 100 may operate in the normal display mode (e.g., the first mode). For example, in FIG. 4, the foldable display panel 100 may have an unfolded status (or be in an unfolded state). However, the normal display mode may not be limited to the unfolded status of the foldable display panel 100. In another exemplary embodiment, the foldable display panel 100 may be operated in the normal display mode when in the folded status (e.g., the folded state) of the foldable display panel 100. For example, the foldable display panel 100 may be operated in the normal display mode when in the folded status (or folded state) of the foldable display panel 100 according to (e.g., depending on or based on) a user setting.

The driving current of the data driver 500 may be determined according to (e.g., based on) a position of an active line that is farthest from the data driver 500 at (e.g., in or on) the active display area where the image is displayed. In FIG. 4, the active display area includes the first and second display areas DA1 and DA2. In FIG. 4, the active line that is the farthest from the data driver 500 at (e.g., in or on) the active display area may be disposed at (e.g., in or on) a third area A3. In FIG. 4, the driving current of the data driver 500 may be determined according to (e.g., based on) a waveform of the data voltage that is applied to the last active line at (e.g., in or on) the third area A3. For example, the driving current of the data driver 500 may be determined such that the data voltage applied to the last active line of the third area A3 is sufficiently charged to (e.g., in) a pixel at (e.g., in or on) the third area A3 that is connected to the last active line of the third area A3.

The data driver 500 may include a plurality of output buffers B1, B2, . . . , BN-1, and BN for outputting data voltages to corresponding data lines DL of the foldable display panel 100. The data driver 500 may further include a digital to analog converter DAC for providing the data voltages to the output buffers B1, B2, . . . , BN-1, and BN. The data driver 500 may further include a current mirror circuit that is connected (e.g., commonly connected) to the output buffers B1, B2, . . . , BN-1, and BN to provide a driving current to the output buffers B1, B2, . . . , BN-1, and BN. The driving current of the data driver 500 may include (or may be) the driving current of the output buffers B1, B2, . . . , BN-1, and BN.

The current mirror circuit may include a first current source for providing a first reference current IREF1, a first switch SW1 connected to (e.g., connected in series with) the first current source, a second current source for providing a second reference current IREF2, and a second switch SW2 connected to (e.g., connected in series with) the second current source. The first switch SW1 and the second switch SW2 may be connected to (e.g., connected in parallel with) each other. The first switch SW1 and the second switch SW2 may be controlled by a switching control signal CONS that is determined according to the display mode. In some embodiments, the switching control signal CONS may be output from the driving controller 200 to the data driver 500. In other embodiments, the switching control signal CONS may be output from a host (or an application processor) to the data driver 500.

The current mirror circuit may include a first transistor TR1 connected to each of the first switch SW1 and the second switch SW2, and a second transistor TR2 connected to the first transistor TR1.

A first power voltage AVDD may be applied to the first current source and the second current source. A second power voltage AVSS may be applied to the first transistor TR1 and the second transistor TR2.

The first transistor TR1 includes an input electrode connected to each of the first switch SW1 and the second switch SW2, a control electrode connected to the input electrode of the first transistor TR1, and an output electrode to receive the second power voltage AVSS.

The second transistor TR2 includes an input electrode connected to each of the output buffers B1, B2, . . . , BN-1, and BN, a control electrode connected to the control electrode of the first transistor TR1, and an output electrode to receive the second power voltage AVSS.

A current IREF that flows through the input electrode of the first transistor TR1 and the output electrode of the first transistor TR1 is equal to or substantially equal to a current IREF that flows through the input electrode of the second transistor TR2 and the output electrode of the second transistor TR2.

The first display area DA1 and the second display area DA2 of FIG. 4 may be activated (e.g., may be in an active state), and the first switch SW1 and the second switch SW2 of FIG. 5 may be turned on. The data driver 500 may be driven according to a first driving current (e.g., IREF=IREF1+IREF2) corresponding to a sum of the first reference current IREF1 that is applied through the first switch SW1 and the second reference current IREF2 that is applied through the second switch SW2.

A waveform of a first data voltage VD1 shown in FIG. 6 may correspond to (or may be) a waveform of the data voltage that is transmitted to a first horizontal line of the first display area DA1 corresponding to a first area A1 of FIG. 4. A waveform of a second data voltage VD2 shown in FIG. 6 may correspond to (or may be) a waveform of the data voltage that is transmitted to a last horizontal line of the first display area DA1 corresponding to a second area A2 of FIG. 4. The waveform of the second data voltage VD2 may have a slew rate that is less than a slew rate of the first data voltage VD1 due to a propagation delay. A waveform of a third data voltage VD3 shown in FIG. 6 may correspond to (or may be) a waveform of the data voltage that is transmitted to the last horizontal line of the second display area DA2 corresponding to the third A3 of FIG. 4. The waveform of the third data voltage VD3 may have a slew rate that is less than the slew rate of the second data voltage VD2 due to a propagation delay.

In FIG. 4, the active display area includes the first and second display areas DA1 and DA2. In FIG. 4, the driving current of the data driver 500 may be determined such that the third data voltage VD3 that is applied to the last horizontal line of the active display area (e.g., the first and second display areas DA1 and DA2) corresponding to the third area A3 is sufficiently charged to (e.g., in) a pixel connected to the last horizontal line of the active display area at (e.g., in or on) the third area A3.

Figure 7:
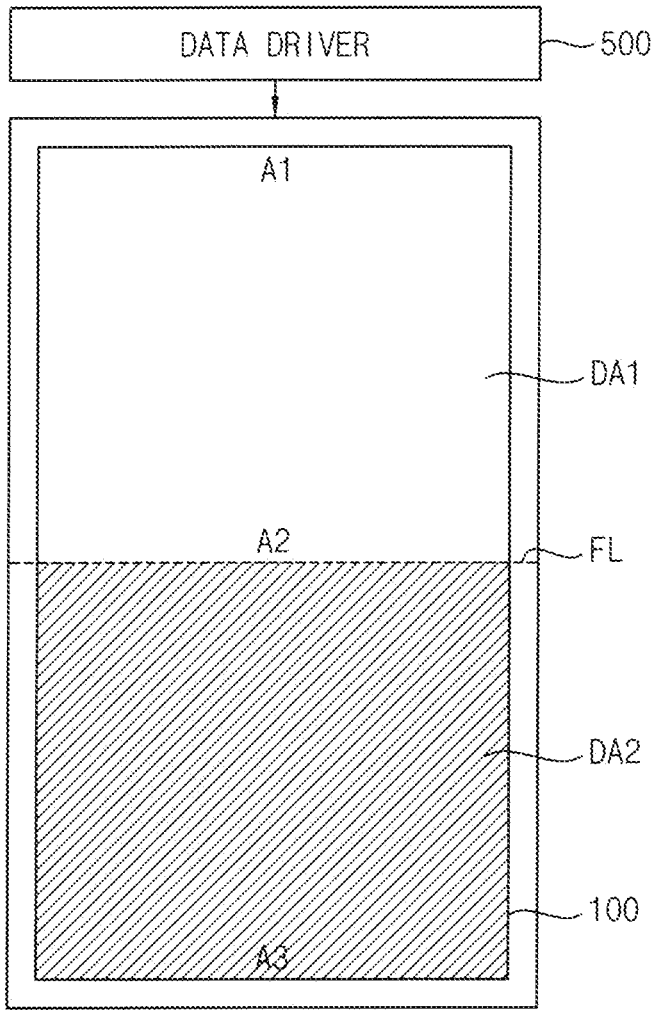
FIG. 7 is a conceptual diagram illustrating the display panel and the data driver of FIG. 1 in a second display mode.
Figure 8:
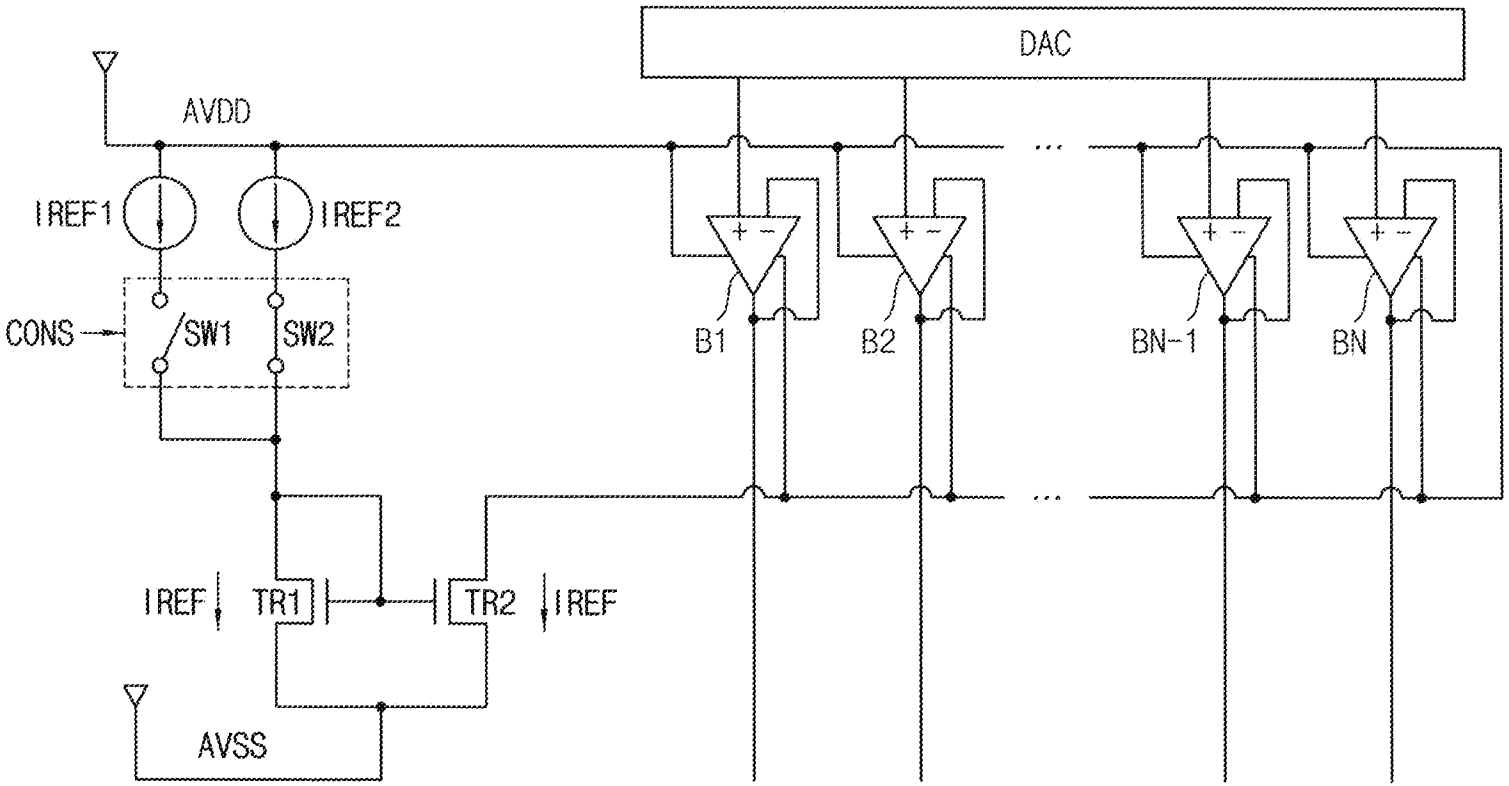
FIG. 8 is a circuit diagram illustrating the data driver of FIG. 1 in the second display mode.
Figure 9:
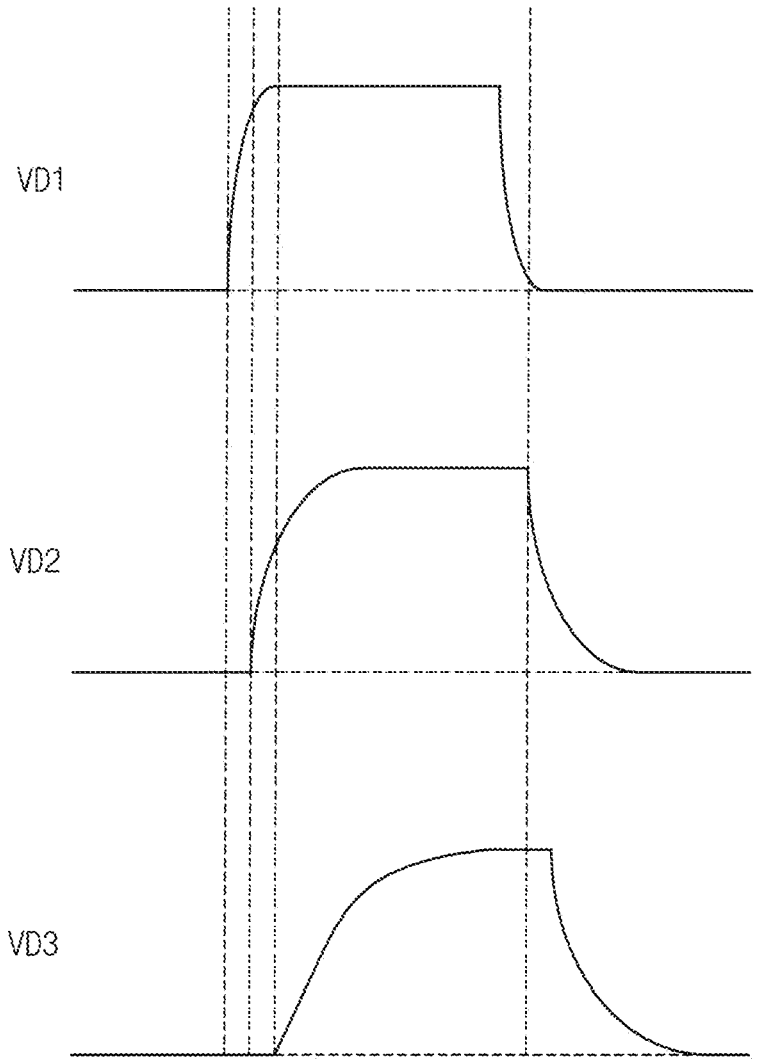
FIG. 9 is a waveform diagram illustrating a data voltage output to the data driver of FIG. 1 in the second display mode.

FIG. 7 is a conceptual diagram illustrating the display panel 100 and the data driver 500 of FIG. 1 in a second display mode. FIG. 8 is a circuit diagram illustrating the data driver 500 of FIG. 1 in the second display mode. FIG. 9 is a waveform diagram illustrating a data voltage output to the data driver 500 of FIG. 1 in the second display mode.

Referring to FIGS. 1 to 9, the foldable display panel 100 may include the first display area DA1 and the second display area DA2. The first display area DA1 may be closer to the data driver 500 than the second display area DA2. For example, the first display area DA1 may be disposed between the data driver 500 and the second display area DA2, such that the first display area DA1 is more adjacent to the data driver 500 than the second display area DA2.

In FIG. 7, the first display area DA1 may be activated (e.g., may be in an active state) and the second display area DA2 may be inactivated (e.g., may be in an inactive state). For example, in FIG. 7, the foldable display panel 100 may operate in the partial display mode (e.g., the second mode). For example, in FIG. 7, the foldable display panel 100 may have a folded status (e.g., may be in a folded state). However, the partial display mode may not be limited to the folded status (or the folded state) of the foldable display panel 100. In another exemplary embodiment, the foldable display panel 100 may be operated in the partial display mode when in the unfolded status (or unfolded state) of the foldable display panel 100. For example, the foldable display panel 100 may be operated in the partial display mode when in the unfolded status (or unfolded state) of the foldable display panel 100 according to (e.g., depending on or based on) a user setting.

The driving current of the data driver 500 may be determined according to (e.g., depending on or based on) a position of an active line that is farthest from the data driver 500 at (e.g., in or on) the active display area where the image is displayed. In FIG. 7, the active display area includes the first display area DA1. In FIG. 7, the active line that is the farthest from the data driver 500 at (e.g., in or on) the active display area may be disposed at (e.g., in or on) the second area A2. In FIG. 7, the driving current of the data driver 500 may be determined according to (e.g., depending on or based on) a waveform of the data voltage that is applied to the last active line at (e.g., in or on) the second area A2. For example, the driving current of the data driver 500 may be determined such that the data voltage that is applied to the last active line of the second area A2 is sufficiently charged to (e.g., in) a pixel disposed at (e.g., in or on) the second area A2 and connected to the last active line of the second area A2.

The first display area DA1 may be activated (e.g., may be in an active state) and the second display area DA2 may be inactivated (e.g., may be in an inactive state) in FIG. 7, and the first switch SW1 may be turned off and the second switch SW2 may be turned on in FIG. 8. For example, the data driver 500 shown in FIG. 8 may have the same or substantially the same circuit structure as that of the data driver 500 shown in FIG. 5. The data driver 500 may be driven according to (e.g., driven in) a second driving current (e.g., IREF=IREF2) corresponding to the second reference current IREF2 that is applied through the second switch SW2.

The first driving current (e.g., IREF=IREF1+IREF2) in FIG. 4 may be greater than the second driving current (e.g., IREF=IREF2) in FIG. 7. In the partial driving mode (e.g., the second mode) of FIG. 7, the data driver 500 may be driven according to (e.g., driven in) the driving current (e.g., IREF=IREF2) that is less than the driving current (e.g., IREF=IREF1+IREF2) of the normal driving mode (e.g., the first mode) of FIG. 4.

A waveform of a first data voltage VD1 shown in FIG. 9 may correspond to (e.g., may be) a waveform of the data voltage that is transmitted to a first horizontal line of the first display area DA1 corresponding to the first area A1 of FIG. 7. A waveform of a second data voltage VD2 shown in FIG. 9 may correspond to (e.g., may be) a waveform of the data voltage that is transmitted to a last horizontal line of the first display area DA1 corresponding to the second area A2 of FIG. 7. The waveform of the second data voltage VD2 may have a slew rate that is less than a slew rate of the first data voltage VD1 due to a propagation delay. A waveform of a third data voltage VD3 shown in FIG. 9 may correspond to (e.g., may be) a waveform of the data voltage that is transmitted to a last horizontal line of the second display area DA2 corresponding to the third area A3 of FIG. 7. The waveform of the third data voltage VD3 may have a slew rate that is less than the slew rate of the second data voltage VD2 due to a propagation delay.

In FIG. 7, the active display area includes the first display area DA1. In FIG. 7, the driving current of the data driver 500 may be determined such that the second data voltage VD2 that is applied to the last horizontal line of the active display area (e.g., the first display area DA1) corresponding to the second area A2 is sufficiently charged to (e.g., in) a pixel connected to the last horizontal line of the active display area at (e.g., in or on) the second area A2.

When the first display area DA1 and the second display area DA2 are activated (e.g., are in an active state) as shown in FIG. 4, the data voltage (e.g. the third data voltage VD3 in FIG. 6) that is transmitted to the last active line of the second display area DA2 (e.g., the last horizontal line at the third area A3) has a first slew rate. When the first display area DA1 is activated (e.g., is in an active state) and the second display area DA2 is inactivated (e.g., is in an inactive state) as shown in FIG. 7, the data voltage (e.g. the second data voltage VD2 in FIG. 9) that is transmitted to the last active line of the first display area DA1 (e.g., the last horizontal line at the second area A2) has a second slew rate. The first slew rate of the data voltage (e.g. the third data voltage VD3 in FIG. 6) may be the same or substantially the same as the second slew rate of the data voltage (e.g. the second data voltage VD2 in FIG. 9). For example, the waveform of the second data voltage VD2 in FIG. 9 may be the same or substantially the same as the waveform of the third data voltage VD3 in FIG. 6.

The third data voltage VD3 in FIG. 9 may not be sufficiently charged to (e.g., in) the pixel at (e.g., in or on) the third area A3. However, as shown in FIG. 7, the second display area DA2 is the inactive area (e.g. an area displaying a black image) so that the display quality may not be deteriorated even though the third data voltage VD3 in FIG. 9 is not sufficiently charged to (e.g., in) the pixel at (e.g., in or on) the third area A3.

Figure 10:
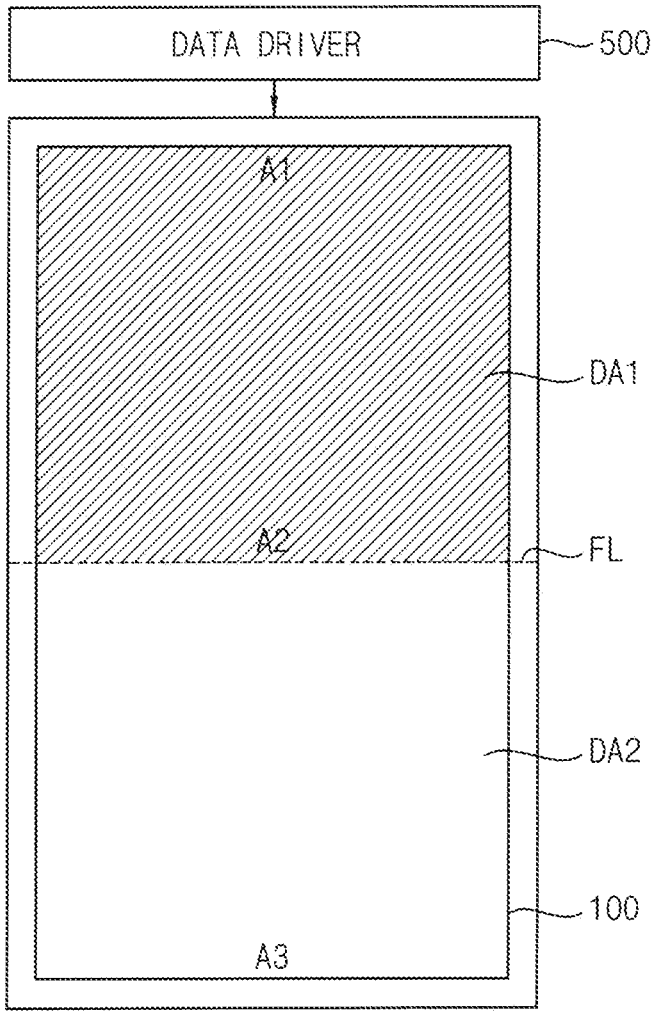
FIG. 10 is a conceptual diagram illustrating the display panel and the data driver of FIG. 1 in a third display mode.
Figure 11:
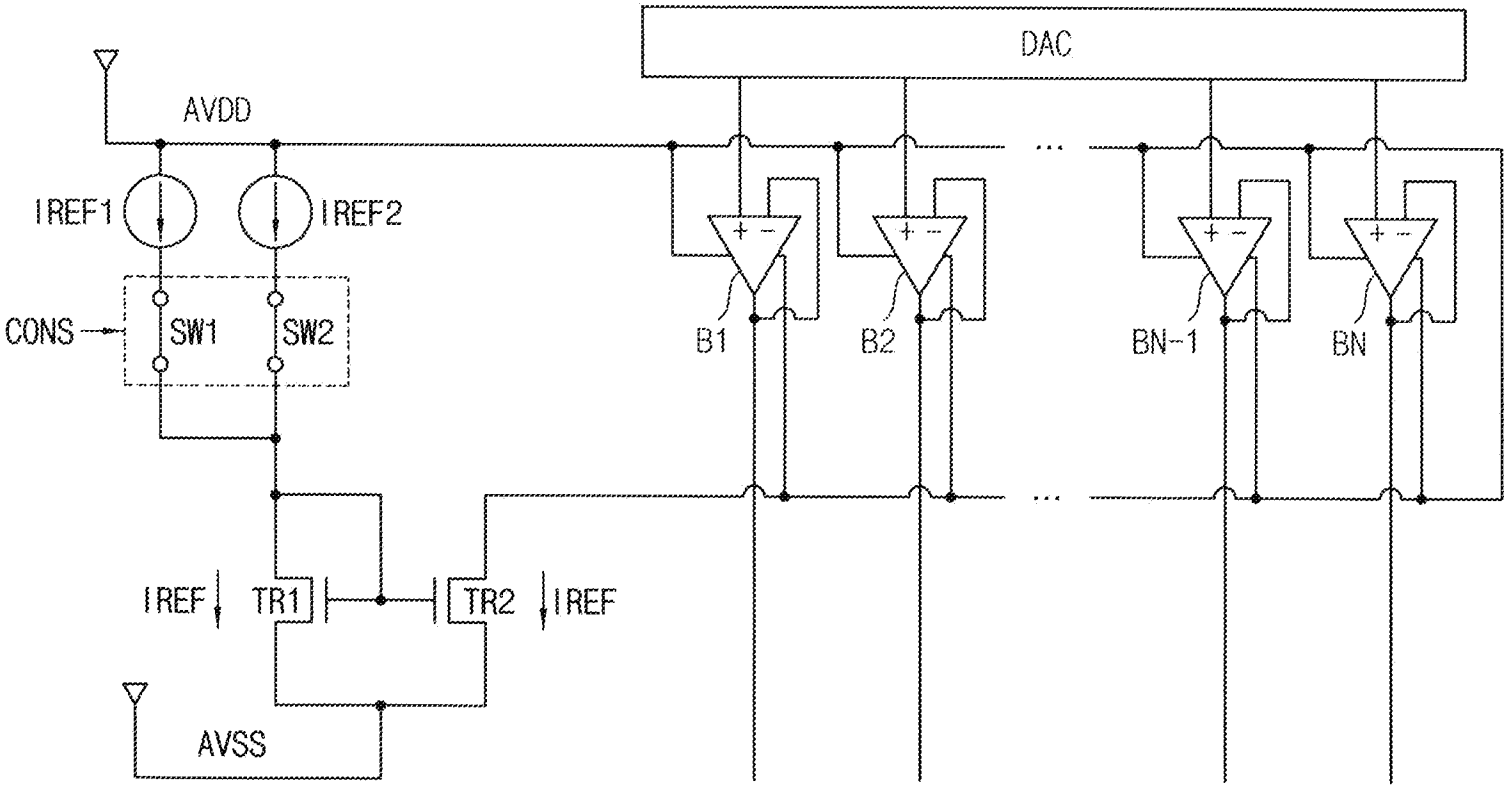
FIG. 11 is a circuit diagram illustrating the data driver of FIG. 1 in the third display mode.
Figure 12:
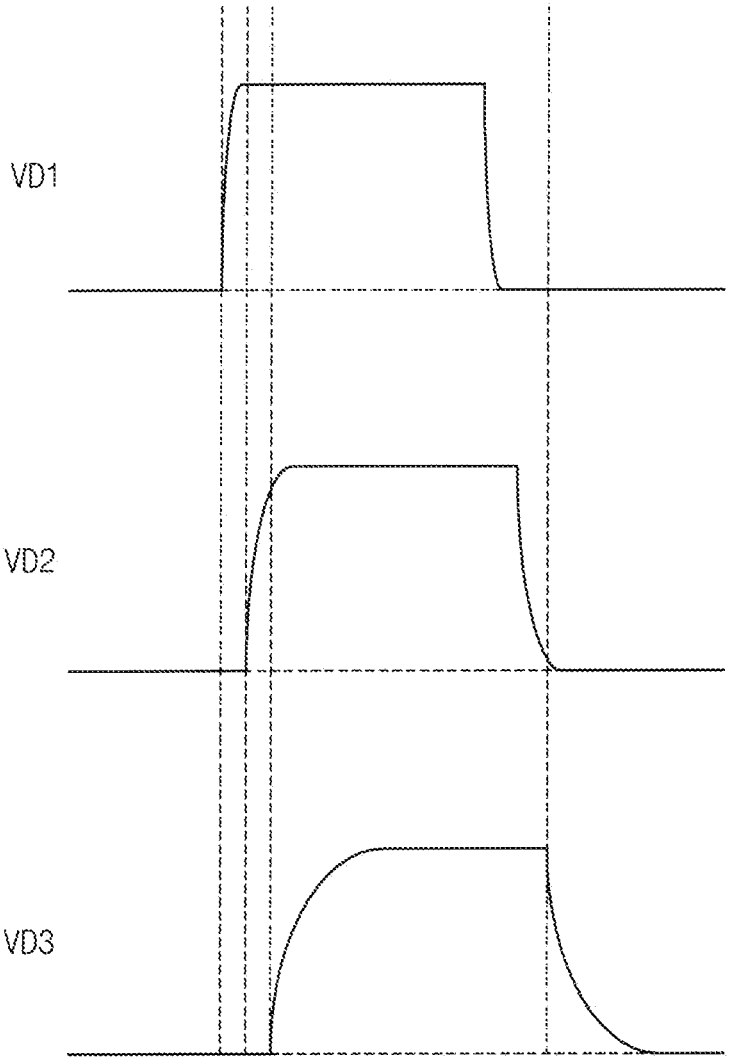
FIG. 12 is a waveform diagram illustrating a data voltage output to the data driver of FIG. 1 in the third display mode.

FIG. 10 is a conceptual diagram illustrating the display panel 100 and the data driver 500 of FIG. 1 in a third display mode. FIG. 11 is a circuit diagram illustrating the data driver 500 of FIG. 1 in the third display mode. FIG. 12 is a waveform diagram illustrating a data voltage output to the data driver 500 of FIG. 1 in the third display mode.

Referring to FIGS. 1 to 12, the foldable display panel 100 may include the first display area DA1 and the second display area DA2. The first display area DA1 may be closer to the data driver 500 than the second display area DA2. For example, the first display area DA1 may be disposed between the data driver 500 and the second display area DA2, such that the first display area DA1 is more adjacent to (e.g., closer to) the data driver 500 than the second display area DA2.

In FIG. 10, the first display area DA1 may be inactivated (e.g., may be in an inactive state) and the second display area DA2 may be activated (e.g., may be in an active state). For example, in FIG. 10, the foldable display panel 100 may operate in the partial display mode. For example, in FIG. 10, the foldable display panel 100 may have a folded status (e.g., may be in a folded state). However, the partial display mode may not be limited to the folded status (or the folded state) of the foldable display panel 100. In another exemplary embodiment, the foldable display panel 100 may be operated in the partial display mode when in the unfolded status (or unfolded state) of the foldable display panel 100. For example, the foldable display panel 100 may be operated in the partial display mode when in the unfolded status (or unfolded state) of the foldable display panel 100 according to (e.g., depending on or based on) a user setting.

The driving current of the data driver 500 may be determined according to (e.g., depending on or based on) a position of an active line that is farthest from the data driver 500 at (e.g., in or on) the active display area where the image is displayed. In FIG. 10, the active display area includes the second display area DA2. In FIG. 10, the active line that is the farthest from the data driver 500 at (e.g., in or on) the active display area may be disposed at (e.g., in or on) the third area A3. In FIG. 10, the driving current of the data driver 500 may be determined according to (e.g., depending on or based on) a waveform of the data voltage that is applied to the last active line at (e.g., in or on) the third area A3. For example, the driving current of the data driver 500 may be determined such that the data voltage that is applied to the last active line of the third area A3 is sufficiently charged to (e.g., in) a pixel disposed at (e.g., in or on) the third area A3 and connected to the last active line of the third area A3. While the third display mode in FIGS. 10 to 12 refers to a partial display mode, the active line that is the farthest from the data driver 500 in the active display area is same or substantially the same as the active line that is the farthest from the data driver 500 in the active display area of the normal display mode in FIGS. 4 to 7, so that the driving current of the data driver 500 in FIGS. 10 to 12 may be the same or substantially the same as the driving current of the data driver 500 in FIGS. 4 to 7.

The first display area DA1 may be inactivated (e.g., may be in an inactive state) and the second display area DA2 may be activated (e.g., may be in an active state) in FIG. 10, and each of the first switch SW1 and the second switch SW2 may be turned on in FIG. 11. For example, the data driver 500 shown in FIG. 11 may have the same or substantially the same circuit structure as that of the data driver 500 shown in FIG. 5. The data driver 500 may be driven according to a third driving current (e.g., IREF=IREF1+IREF2) corresponding to a sum of the first reference current IREF1 that is applied through the first switch SW1 and the second reference current IREF2 that is applied through the second switch SW2.

The first driving current (e.g., IREF=IREF1+IREF2) in FIG. 4 may be the same or substantially the same as the third driving current (e.g., IREF=IREF1+IREF2) in FIG. 10.

A waveform of a first data voltage VD1 shown in FIG. 12 may correspond to (e.g., may be) a waveform of the data voltage that is transmitted to a first horizontal line of the first display area DA1 corresponding to the first area A1 of FIG. 10. A waveform of a second data voltage VD2 shown in FIG. 12 may correspond to (e.g., may be) a waveform of the data voltage that is transmitted to a last horizontal line of the first display area DA1 corresponding to the second area A2 of FIG. 10. The waveform of the second data voltage VD2 may have a slew rate that is less than a slew rate of the first data voltage VD1 due to a propagation delay. A waveform of a third data voltage VD3 shown in FIG. 12 may correspond to (e.g., may be) a waveform of the data voltage that is transmitted to a last horizontal line of the second display area DA2 corresponding to the third area A3 of FIG. 10. The waveform of the third data voltage VD3 may have a slew rate that is less than the slew rate of the second data voltage VD2 due to a propagation delay.

In FIG. 10, the active display area includes the second display area DA2. In FIG. 10, the driving current of the data driver 500 may be determined such that the third data voltage VD3 that is applied to the last horizontal line of the active display area (e.g., the second display area DA2) corresponding to the third area A3 is sufficiently charged to (e.g., in) a pixel connected to the last horizontal line of the active display area at (e.g., in or on) the third area A3.

According to the present exemplary embodiment, the data driver 500 is driven using different driving currents when operating in the normal display mode and the partial driving mode so that power consumption of the data driver 500 when operating in the partial driving mode may be reduced. For example, the driving current of the data driver 500 may be variously adjusted according to (e.g., depending on or based on) a position of the last horizontal line that is the farthest from the data driver at (e.g., in or on) the active display area where the image is displayed so that the power consumption of the data driver 500 may be reduced.

Figure 13:
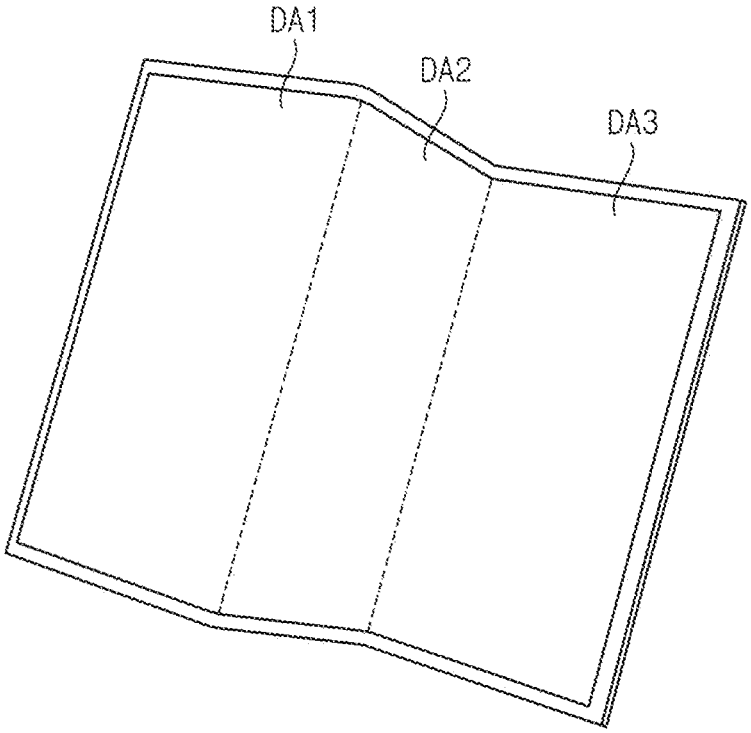
FIG. 13 is a perspective view illustrating a display apparatus according to an exemplary embodiment of the present inventive concept.
Figure 14:
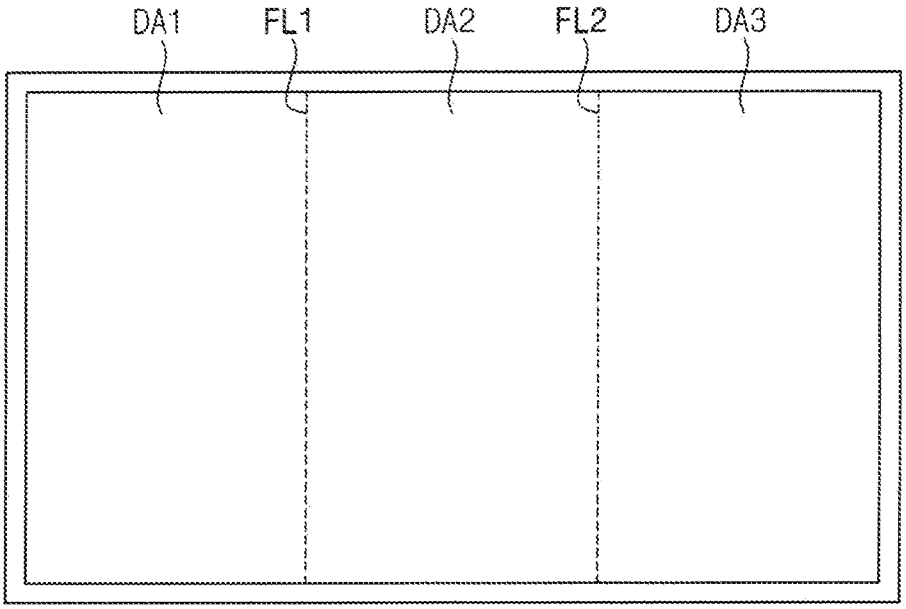
FIG. 14 is a plan view illustrating the display apparatus of FIG. 13.

FIG. 13 is a perspective view illustrating a display apparatus according to an exemplary embodiment of the present inventive concept. FIG. 14 is a plan view (e.g., a view from a plane that is parallel to or substantially parallel to a top surface of the display apparatus) illustrating the display apparatus of FIG. 13.

The display apparatus and the method of driving the display apparatus according to the present exemplary embodiment is the same or substantially the same as the display apparatus and the method of driving the display apparatus of the one or more exemplary embodiments described with reference to FIGS. 1 to 12, except that a foldable display panel of the display apparatus according to the present exemplary embodiment includes three display areas. Accordingly, the same reference symbols will be used to refer to the same or substantially the same (e.g., or like) parts and components as those described with reference to the one or more exemplary embodiments of FIGS. 1 to 12, and thus, redundant description thereof may not be repeated.

Referring to FIGS. 3, 13, and 14, the display apparatus may include a flexible display panel. The display apparatus may be a foldable display apparatus. For example, the display apparatus may be folded along a first folding line FL1 and a second folding line FL2.

The display apparatus may include a first display area DA1 disposed at (e.g., in or on) a first side (or a first area) of the display panel relative to the first folding line FL1, a second display area DA2 disposed at (e.g., in or on) a second side (or a second area) of the display panel relative to the first folding line FL1 and at (e.g., in or on) a first side (or first area) of the display panel relative to the second folding line FL2, and a third display area DA3 disposed at (e.g., in or on) a second side (or a second area) of the display panel relative to the second folding line FL2.

In some embodiments, when the display apparatus is folded (e.g., in a folded state) as shown in FIG. 13, the first display area DA1 may display an image and each of the second display area DA2 and the third display area DA3 may not display an image. In other embodiments, when the display apparatus is folded (e.g., in a folded state), the third display area DA3 may display an image and each of the first display area DA1 and the second display area DA2 may not display an image. However, the present inventive concept is not limited thereto, and the displaying of the image at the first, second, and third display areas DA1, DA2, and DA3 may be configured (e.g., set) according to (e.g., depending on or based on) a user setting.

Figure 15:
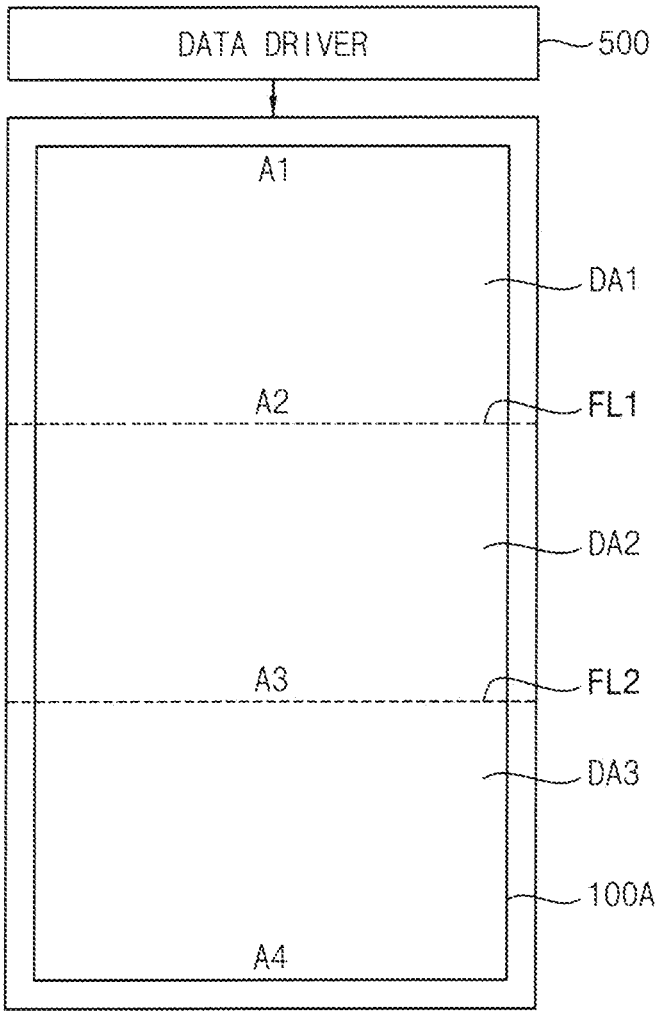
FIG. 15 is a conceptual diagram illustrating a display panel and a data driver of the display apparatus of FIG. 13 in a first display mode.
Figure 16:
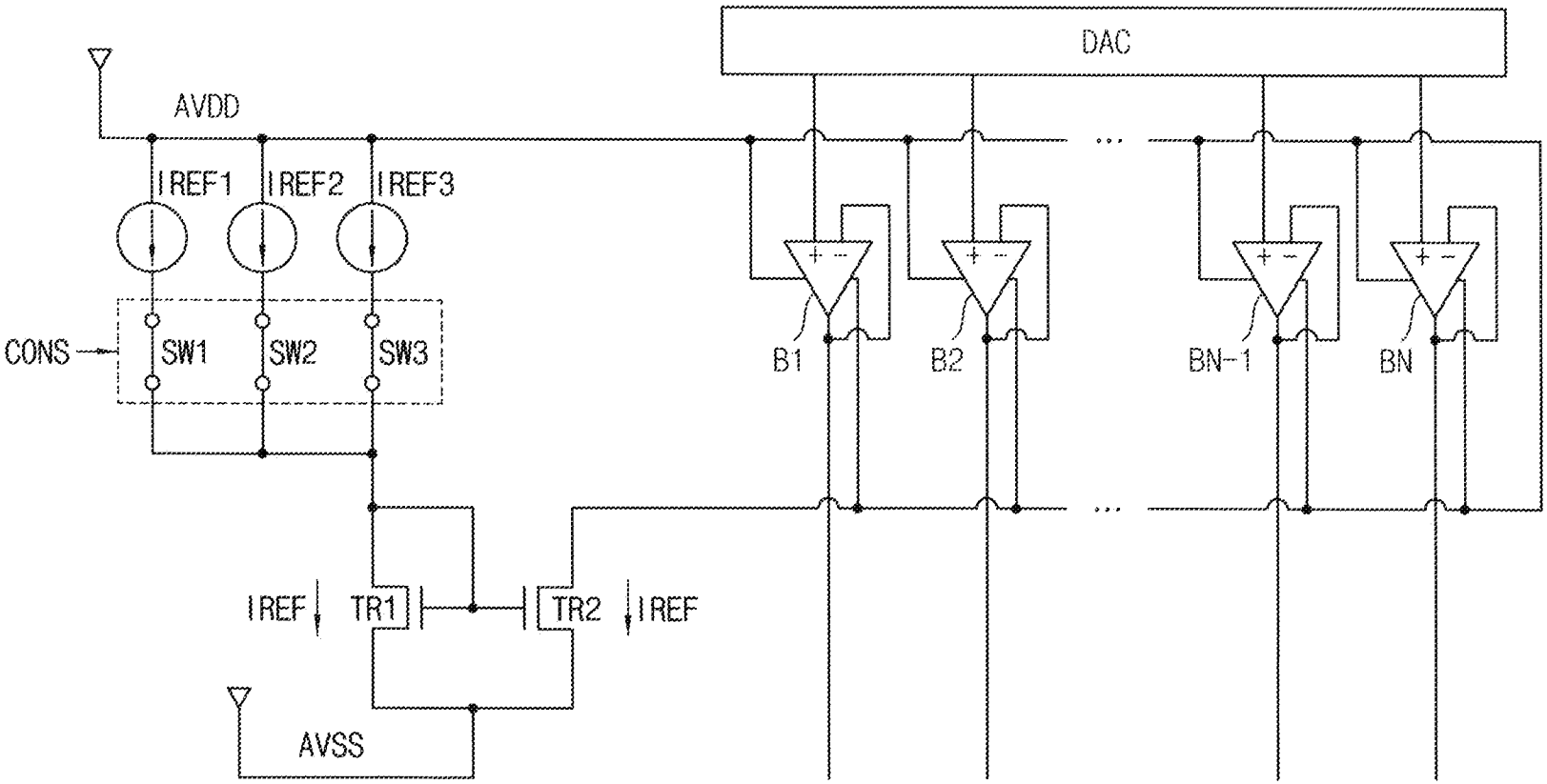
FIG. 16 is a circuit diagram illustrating the data driver of the display apparatus of FIG. 13 in the first display mode.
Figure 17:
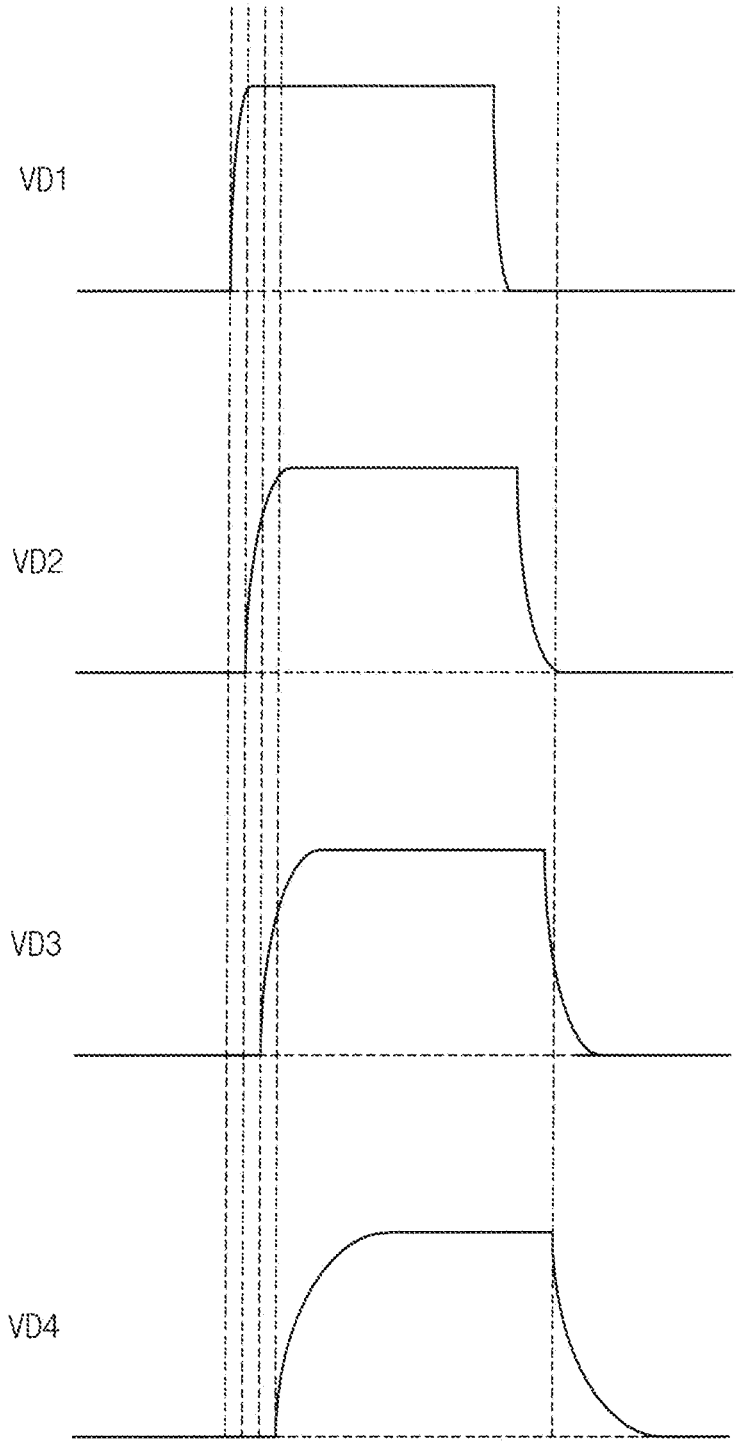
FIG. 17 is a waveform diagram illustrating a data voltage output to the data driver of the display apparatus of FIG. 13 in the first display mode.

FIG. 15 is a conceptual diagram illustrating the display panel 100A and a data driver 500 of the display apparatus of FIG. 13 in a first display mode. FIG. 16 is a circuit diagram illustrating the data driver 500 of the display apparatus of FIG. 13 in the first display mode. FIG. 17 is a waveform diagram illustrating a data voltage output to the data driver 500 of the display apparatus of FIG. 13 in the first display mode.

Referring to FIGS. 3 and 13 to 17, a display mode of the foldable display panel 100A may be determined according to (e.g., depending on or based on) a folded status (e.g., a folded state) of the foldable display panel 100A. For example, the display mode may include a normal display mode and a partial display mode. In the normal display mode, an image is displayed on an entire display area (e.g., on each of the first, second, and third display areas DA1, DA2, and DA3) of the foldable display panel 100A. In the partial display mode, an image is displayed on a part (or portion) of the display area of the foldable display panel 100A. For example, when the foldable display panel 100A is folded (e.g., in a folded state), the foldable display panel 100A may operate in the partial display mode. For example, when the foldable display panel 100A is unfolded (e.g., in an unfolded state), the foldable display panel 100A may operate in the normal display mode.

A driving current of the data driver 500 may be varied according to (e.g., depending on or based on) the display mode. For example, when the display mode is the normal display mode, the data driver 500 may be driven according to a first driving current. For example, when the display mode is the partial display mode, the data driver 500 may be driven according to a second driving current. The first driving current may be greater than the second driving current.

In FIG. 15, the foldable display panel 100A may include the first display area DA1, the second display area DA2, and the third display area DA3. The first display area DA1 may be closer to the data driver 500 than the second display area DA2. For example, the first display area DA1 may be disposed between the data driver 500 and the second display area DA2, such that the first display area DA1 is more adjacent to the data driver 500 than the second display area DA2. The second display area DA2 may be closer to the data driver 500 than the third display area DA3. For example, the second display area DA2 may be disposed between the data driver 500 and the third display area DA3, such that the second display area DA2 is more adjacent to the data driver 500 than the third display area DA3.

In FIG. 15, each of the first display area DA1, the second display area DA2, and the third display area DA3 may be activated (e.g., may be in an active state). For example, in FIG. 15, the foldable display panel 100A may operate in the normal display mode. For example, in FIG. 15, the foldable display panel 100A may have an unfolded status (e.g., may be in an unfolded state). However, the normal display mode may not be limited to the unfolded status (or the unfolded state) of the foldable display panel 100A. In other embodiments, the foldable display panel 100A may be operated in the normal display mode while in the folded status (or while in the folded state) of the foldable display panel 100A. For example, the foldable display panel 100A may be operated in the normal display mode while in the folded status (or folded state) of the foldable display panel 100A according to (e.g., depending on or based on) a user setting.

The driving current of the data driver 500 may be determined according to (e.g., depending on or based on) a position of an active line that is farthest from the data driver 500 at (e.g., in or on) the active display area where the image is displayed. In FIG. 15, the active display area includes each of the first, second, and third display areas DA1, DA2, and DA3. In FIG. 15, the active line that is the farthest from the data driver 500 at (e.g., in or on) the active display area may be disposed at (e.g., in or on) a fourth area A4. In FIG. 15, the driving current of the data driver 500 may be determined according to (e.g., depending on or based on) a waveform of the data voltage that is applied to the last active line at (e.g., in or on) the fourth area A4. For example, the driving current of the data driver 500 may be determined such that the data voltage that is applied to the last active line of the fourth area A4 is sufficiently charged to (e.g., in) a pixel that is disposed at (e.g., in or on) the fourth area A4 and connected to the last active line of the fourth area A4.

The data driver 500 may include a current mirror circuit. The current mirror circuit of the data driver 500 may include a first current source for providing a first reference current IREF1, a first switch SW1 connected in series to the first current source, a second current source for providing a second reference current IREF2, a second switch SW2 connected in series to the second current source, a third current source for providing a third reference current IREF3, and a third switch SW3 connected in series to the third current source. The first switch SW1, the second switch SW2, and the third switch SW3 may be connected to each other. For example, the first switch SW1, the second switch SW2, and the third switch SW3 may be connected in parallel to each other. The first switch SW1, the second switch SW2, and the third switch SW3 may be controlled by a switching control signal CONS that is determined according to the display mode.

Each of the first display area DA1, the second display area DA2, and the third display area DA3 may be activated (e.g., may be in an active state) in FIG. 15, and each of the first switch SW1, the second switch SW2, and the third switch SW3 may be turned on in FIG. 16. The data driver 500 may be driven according to a first driving current (e.g., IREF=IREF1+IREF2+IREF3) corresponding to a sum of the first reference current IREF1 that is applied through the first switch SW1, the second reference current IREF2 that is applied through the second switch SW2, and the third reference current IREF3 that is applied through the third switch SW3.

A waveform of a first data voltage VD1 shown in FIG. 17 may correspond to (e.g., may be) a waveform of the data voltage that is transmitted to a first horizontal line of the first display area DA1 corresponding to a first area A1 of FIG. 15. A waveform of a second data voltage VD2 shown in FIG. 17 may correspond to (e.g., may be) a waveform of the data voltage that is transmitted to a last horizontal line of the first display area DA1 corresponding to a second area A2 of FIG. 15. The waveform of the second data voltage VD2 may have a slew rate that is less than a slew rate of the first data voltage VD1 due to a propagation delay. A waveform of a third data voltage VD3 shown in FIG. 17 may correspond to (e.g., may be) a waveform of the data voltage that is transmitted to a last horizontal line of the second display area DA2 corresponding to a third area A3 of FIG. 15. The waveform of the third data voltage VD3 may have a slew rate that is less than the slew rate of the second data voltage VD2 due to a propagation delay. A waveform of a fourth data voltage VD4 shown in FIG. 17 may correspond to (e.g., may be) a waveform of the data voltage that is transmitted to a last horizontal line of the third display area DA3 corresponding to the fourth area A4 of FIG. 15. The waveform of the fourth data voltage VD4 may have a slew rate that is less than the slew rate of the third data voltage VD3 due to a propagation delay.

In FIG. 15, the active display area includes each of the first, second, and third display areas DA1, DA2, and DA3. In FIG. 15, the driving current of the data driver 500 may be determined such that the fourth data voltage VD4 that is applied to the last horizontal line of the active display area (e.g., the first, second, and third display areas DA1, DA2, and DA3) corresponding to the fourth area A4 is sufficiently charged to (e.g., in) a pixel connected to the last horizontal line at (e.g., in or on) the fourth area A4.

Figure 18:
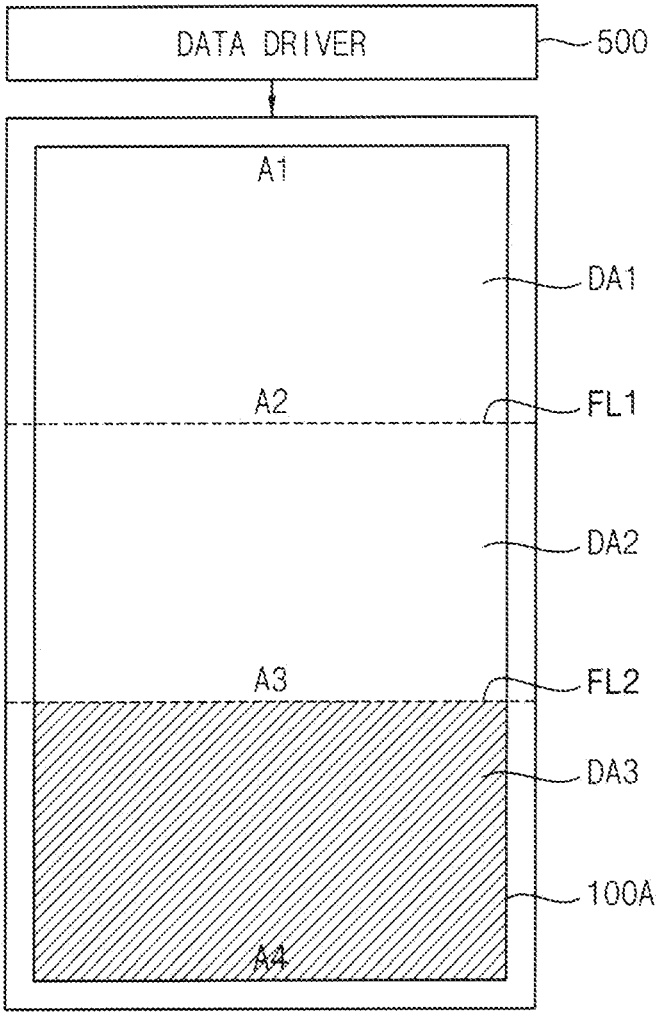
FIG. 18 is a conceptual diagram illustrating the display panel and the data driver of the display apparatus of FIG. 13 in a second display mode.
Figure 19:
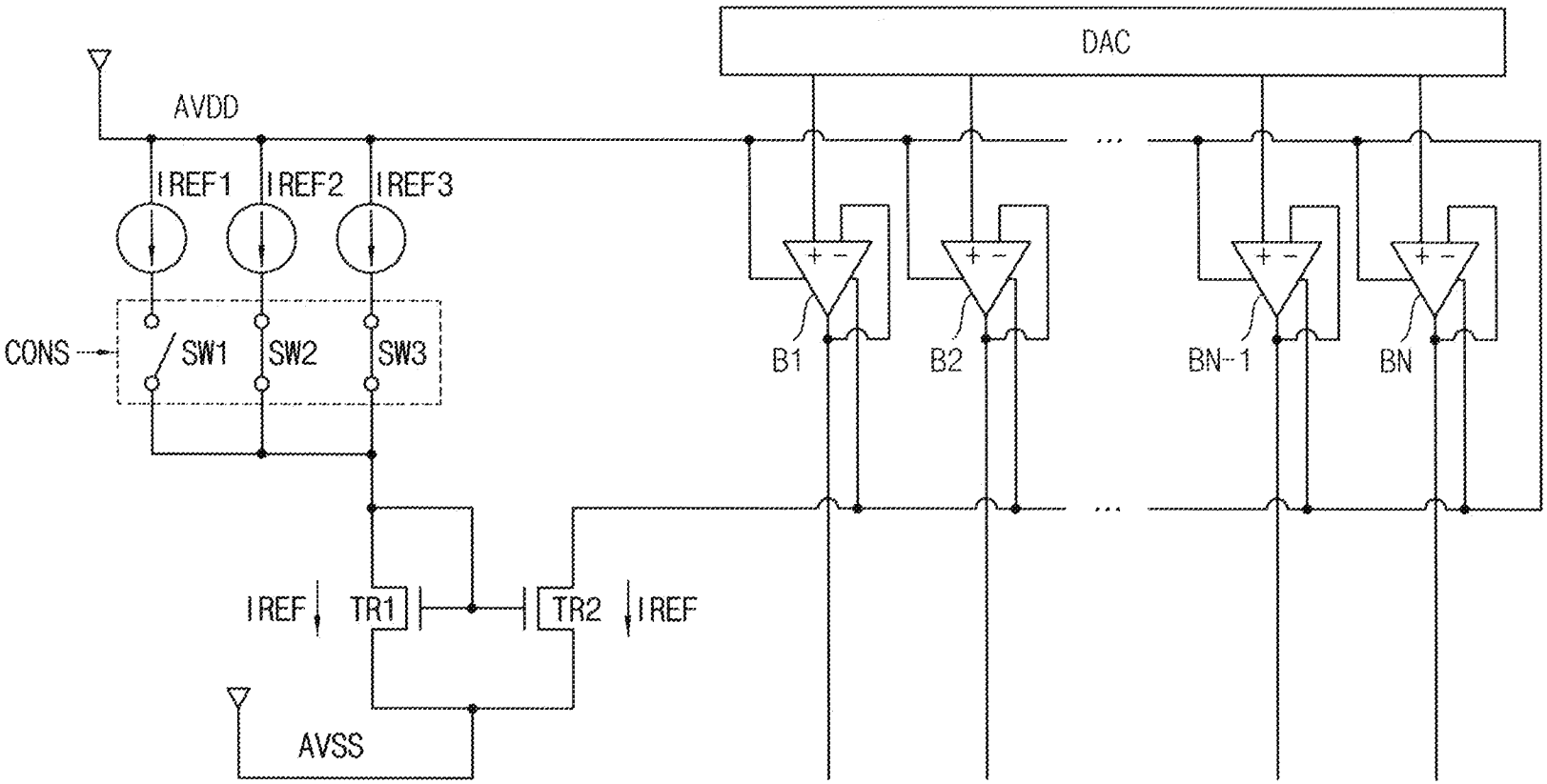
FIG. 19 is a circuit diagram illustrating the data driver of the display apparatus of FIG. 13 in the second display mode.
Figure 20:
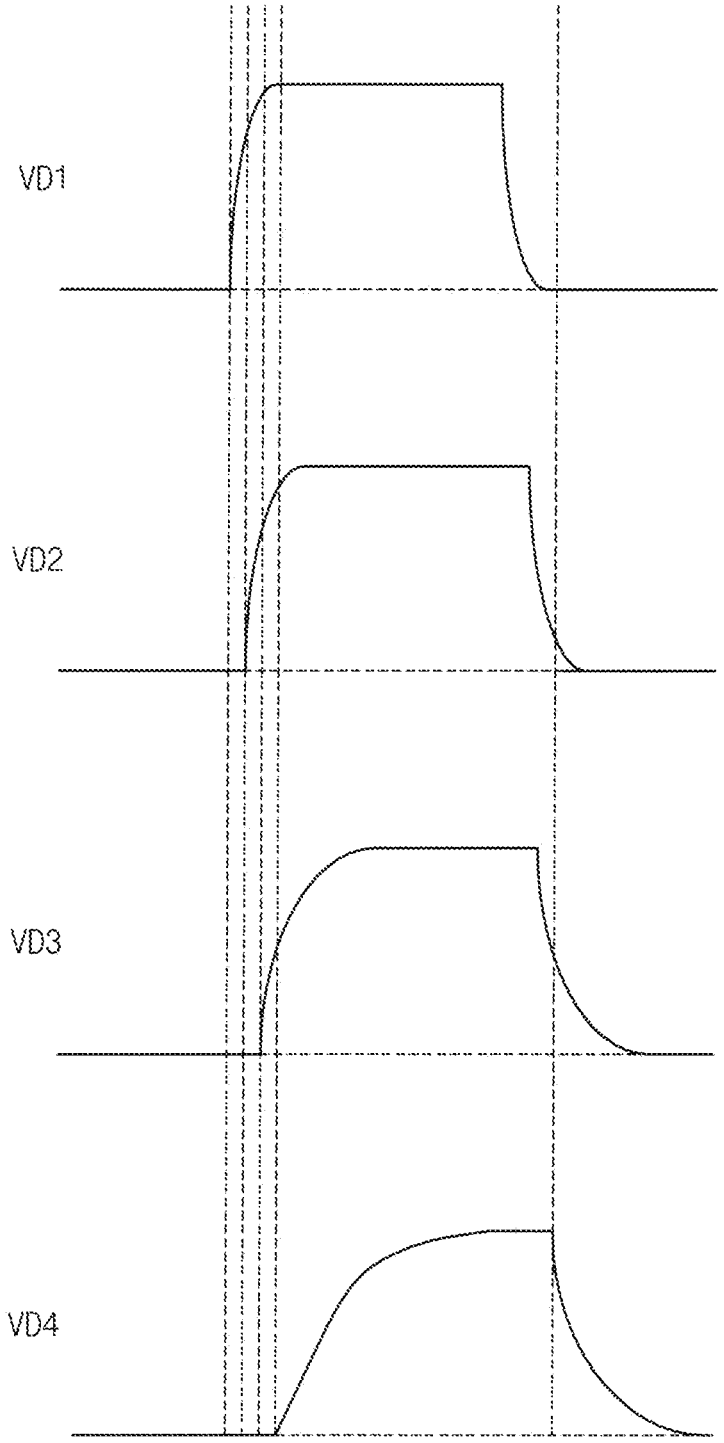
FIG. 20 is a waveform diagram illustrating a data voltage output to the data driver of the display apparatus of FIG. 13 in the second display mode.

FIG. 18 is a conceptual diagram illustrating the display panel 100A and the data driver 500 of the display apparatus of FIG. 13 in a second display mode. FIG. 19 is a circuit diagram illustrating the data driver 500 of the display apparatus of FIG. 13 in the second display mode. FIG. 20 is a waveform diagram illustrating a data voltage output to the data driver 500 of the display apparatus of FIG. 13 in the second display mode.

Referring to FIGS. 3 and 13 to 20, the first display area DA1 and the second display area DA2 may be activated (e.g., may be in an active state) and the third display area DA3 may be inactivated (e.g., may be in an inactive state) in FIG. 18. For example, in FIG. 18, the foldable display panel 100A may operate in the partial display mode, such that an image is displayed at the first and second display areas DA1 and DA2 and an image is not displayed at the third display area DA3.

The driving current of the data driver 500 may be determined according to (e.g., depending on or based on) a position of an active line that is farthest from the data driver 500 at (e.g., in or on) the active display area (e.g., the first and second display areas DA1 and DA2) where the image is displayed. In FIG. 18, the active display area includes the first and second display areas DA1 and DA2. In FIG. 18, the active line that is the farthest from the data driver 500 at (e.g., in or on) the active display area may be disposed at (e.g., in or on) the third area A3. In FIG. 18, the driving current of the data driver 500 may be determined according to (e.g., depending on or based on) a waveform of the data voltage that is applied to the last active line at (e.g., in or on) the third area A3. For example, the driving current of the data driver 500 may be determined such that the data voltage that is applied to the last active line of the third area A3 is sufficiently charged to (e.g., in) a pixel that is disposed at (e.g., in or on) the third A3 and connected to the last active line of the third area A3.

Each of the first display area DA1 and the second display area DA2 may be activated (e.g., may be in an active state) and the third display area DA3 may be inactivated (e.g., may be in an inactive state) in FIG. 18, and the first switch SW1 may be turned off and each of the second and third switches SW2 and SW3 may be turned on in FIG. 19. For example, the data driver 500 shown in FIG. 19 may have the same or substantially the same circuit structure as that of the data driver 500 shown in FIG. 16. The data driver 500 may be driven according to a second driving current (e.g., IREF=IREF2+IREF3) corresponding to a sum of the second reference current IREF2 that is applied through the second switch SW2 and the third reference current IREF3 that is applied through the third switch SW3.

The first driving current (e.g., IREF=IREF1+IREF2+IREF3) in FIG. 15 may be greater than the second driving current (e.g., IREF=IREF2+IREF3) in FIG. 18. In the partial driving mode of FIG. 18, the data driver 500 may be driven according to the driving current (e.g., IREF=IREF2+IREF3) that is less than the driving current (e.g., IREF=IREF1+IREF2+IREF3) of the normal driving mode of FIG. 15.

In FIG. 18, the active display area includes each of the first and second display areas DA1 and DA2. In FIG. 18, the driving current of the data driver 500 may be determined such that the third data voltage VD3 that is applied to the last horizontal line of the active display area (e.g., the first and second display areas DA1 and DA2) corresponding to the third area A3 is sufficiently charged to (e.g., in) a pixel that is connected to the last horizontal line of the third area A3.

When each of the first display area DA1, the second display area DA2, and the third display area DA3 are activated (e.g., are in an active state) as shown in FIG. 15, the data voltage (e.g., the fourth data voltage VD4 shown in FIG. 17) that is transmitted to the last active line of the third display area DA3 has a first slew rate. When each of the first display area DA1 and the second display area DA2 are activated (e.g., are in an active state) and the third display area DA3 is inactivated (e.g., is in an inactive state) as shown in FIG. 18, the data voltage (e.g., the third data voltage VD3 shown in FIG. 20) that is transmitted to the last active line of the second display area DA2 has a second slew rate. The first slew rate of the data voltage (e.g., the fourth data voltage VD4 shown in FIG. 17) may be the same or substantially the same as the second slew rate of the data voltage (e.g., the third data voltage VD3 shown in FIG. 20). The waveform of the third data voltage VD3 shown in FIG. 20 may be the same or substantially the same as the waveform of the fourth data voltage VD4 shown in FIG. 17.

The fourth data voltage VD4 shown in FIG. 20 may not be sufficiently charged to (e.g., in) the pixel at (e.g., in or on) the third area A3. However, as shown in FIG. 18, the third display area DA3 is the inactive area (e.g., an area for displaying a black image) so that the display quality may not be deteriorated even though the fourth data voltage VD4 shown in FIG. 20 is not sufficiently charged to (e.g., in) the pixel at (e.g., in or on) the fourth area A4.

Figure 21:
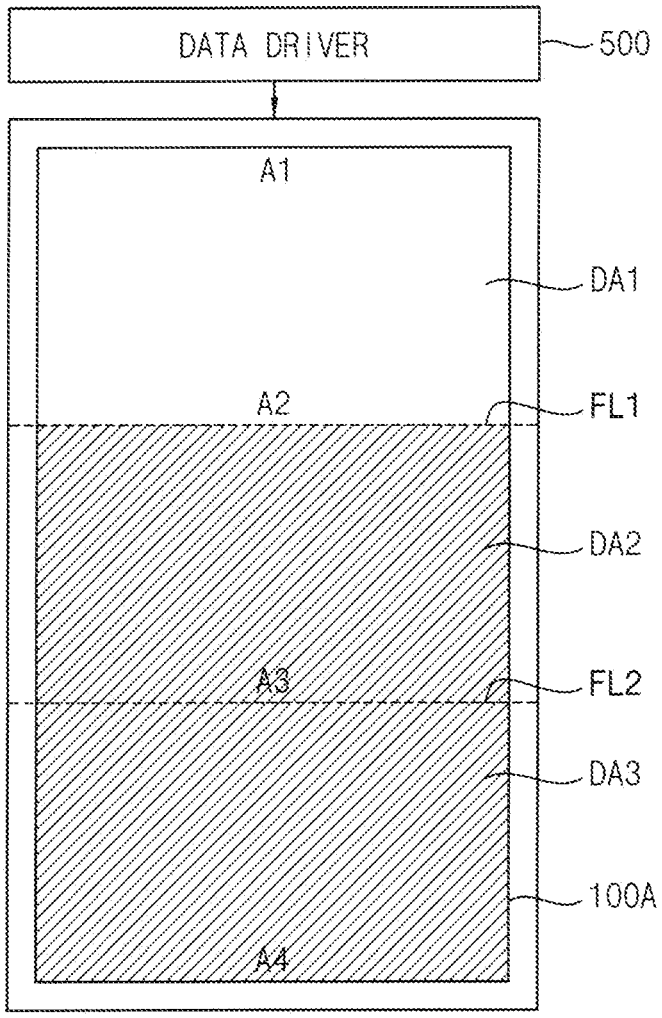
FIG. 21 is a conceptual diagram illustrating the display panel and the data driver of the display apparatus of FIG. 13 in a third display mode.
Figure 22:
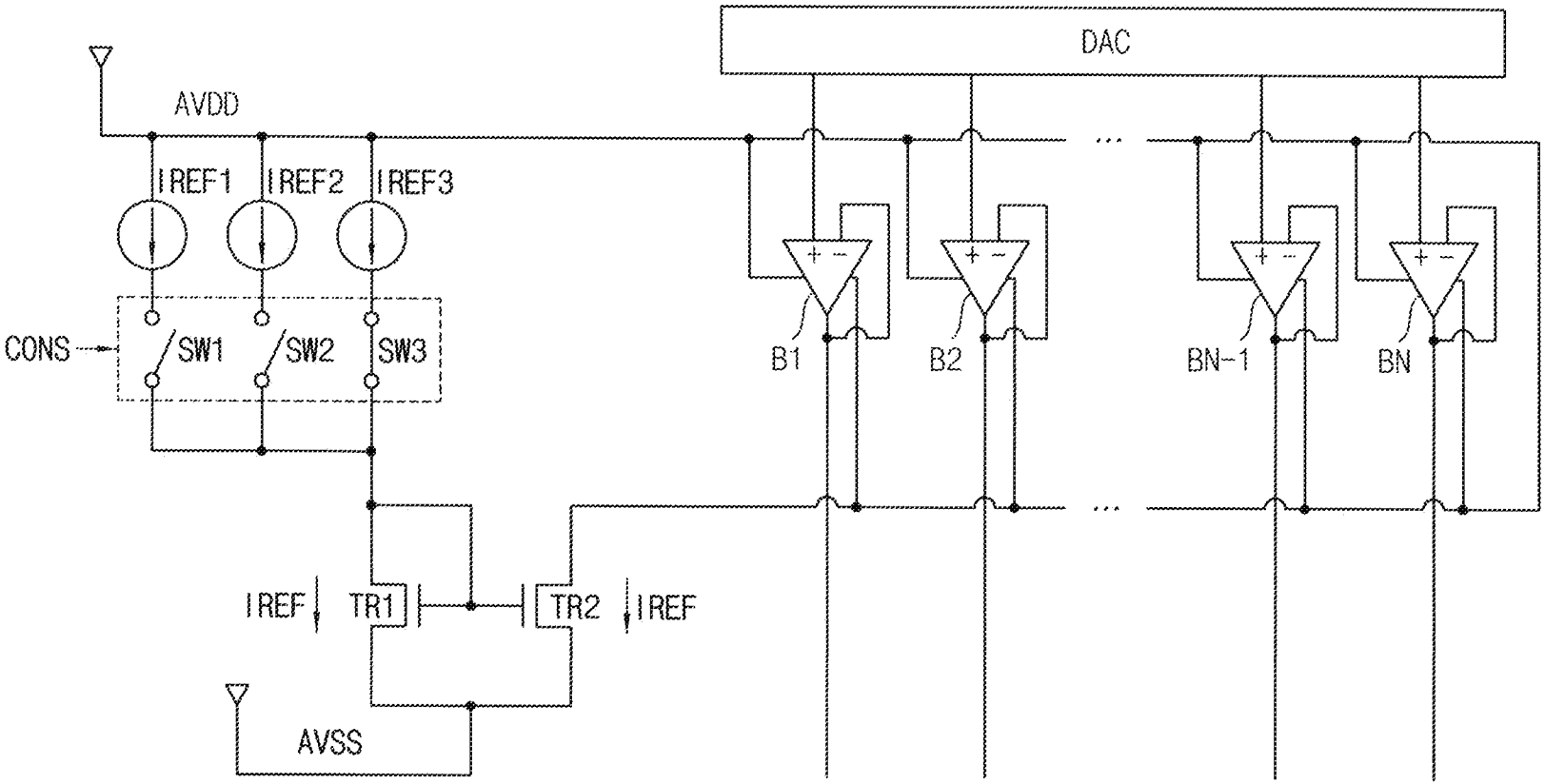
FIG. 22 is a circuit diagram illustrating the data driver of the display apparatus of FIG. 13 in the third display mode.
Figure 23:
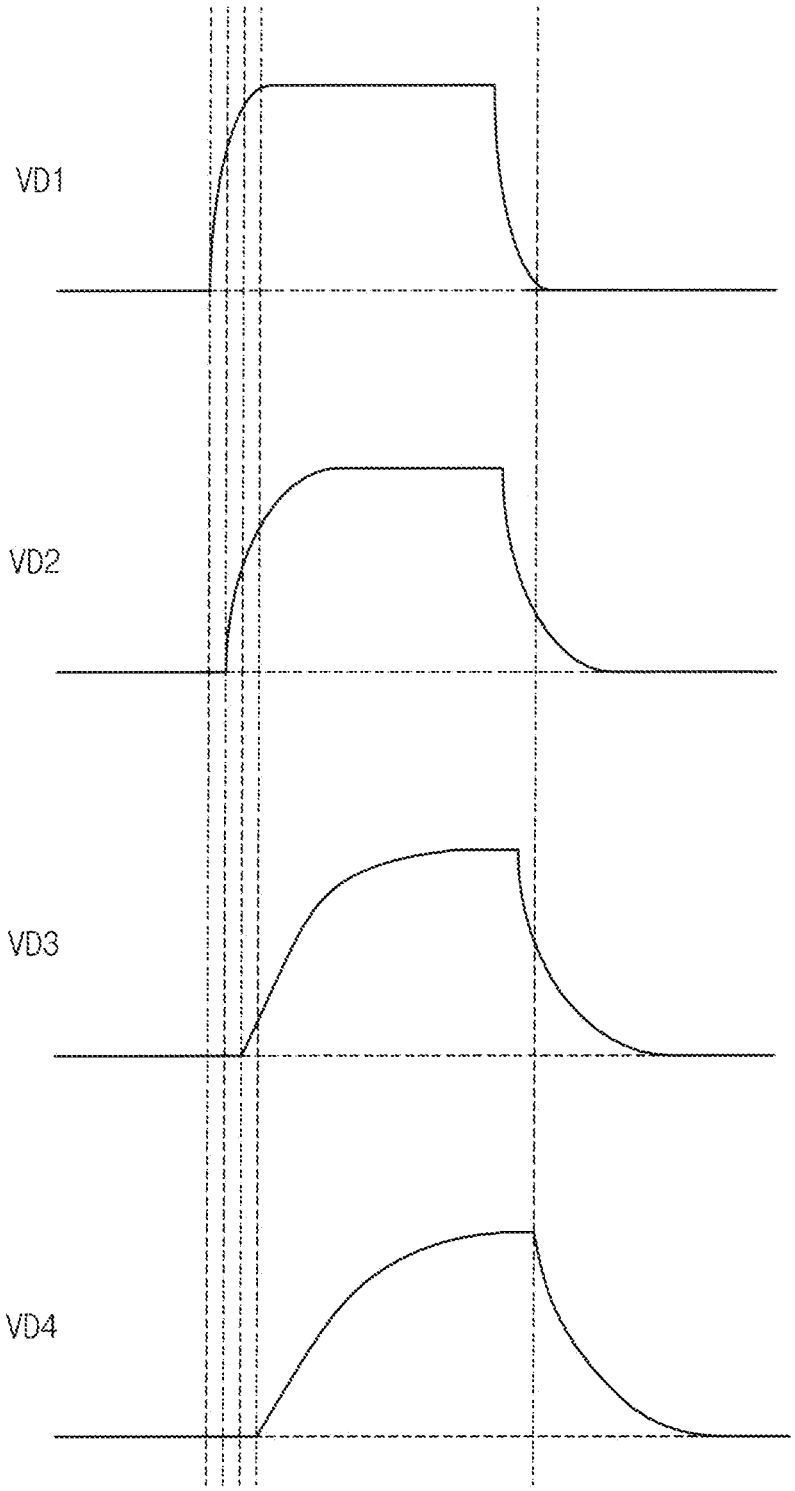
FIG. 23 is a waveform diagram illustrating a data voltage output to the data driver of the display apparatus of FIG. 13 in the third display mode.

FIG. 21 is a conceptual diagram illustrating the display panel 100A and the data driver 500 of the display apparatus of FIG. 13 in a third display mode. FIG. 22 is a circuit diagram illustrating the data driver 500 of the display apparatus of FIG. 13 in the third display mode. FIG. 23 is a waveform diagram illustrating a data voltage output to the data driver 500 of the display apparatus of FIG. 13 in the third display mode.

Referring to FIGS. 3 and 13 to 23, the first display area DA1 may be activated (e.g., may be in an active state) and each of the second display area DA2 and the third display area DA3 may be inactivated (e.g., may be in an inactive state) in FIG. 21. For example, in FIG. 21, the foldable display panel 100A may operate in the partial display mode.

The driving current of the data driver 500 may be determined according to (e.g., depending on or based on) a position of an active line that is farthest from the data driver 500 at (e.g., in or on) the active display area (e.g., the first display area DA1) where the image is displayed. In FIG. 21, the active display area includes the first display area DA1. In FIG. 21, the active line that is the farthest from the data driver 500 at (e.g., in or on) the active display area may be disposed at (e.g., in or on) the second area A2. In FIG. 21, the driving current of the data driver 500 may be determined according to (e.g., depending on or based on) a waveform of the data voltage that is applied to the last active line at (e.g., in or on) the second area A2. For example, the driving current of the data driver 500 may be determined such that the data voltage that is applied to the last active line of the second area A2 is sufficiently charged to (e.g., in) a pixel at (e.g., in or on) the second area A2 and connected to the last active line of the second area A2.

The first display area DA1 may be activated (e.g., may be in an active state) and each of the second display area DA2 and the third display area DA3 may be inactivated (e.g., may be in an inactive state) in FIG. 21, and each of the first switch SW1 and the second switch SW2 may be turned off and the third switch SW2 may be turned on in FIG. 22. For example, the data driver 500 shown in FIG. 22 may have the same or substantially the same circuit structure as that of the data driver 500 shown in FIG. 16. The data driver 500 may be driven according to a third driving current (e.g., IREF=IREF3) corresponding to the third reference current IREF3 that is applied through the third switch SW3.

The second driving current (e.g., IREF=IREF2+IREF3) in FIG. 18 may be greater than the third driving current (e.g., IREF=IREF3) in FIG. 21. In the partial driving mode of FIG. 21, the data driver 500 may be driven according to the driving current (e.g., IREF=IREF3) that is less than the driving current (e.g., IREF=IREF2+IREF3) of the partial driving mode of FIG. 18.

In FIG. 21, the active display area includes the first display area DA1. In FIG. 21, the driving current of the data driver 500 may be determined such that the second data voltage VD2 that is applied to the last horizontal line of the active display area (e.g., the first display area DA1) corresponding to the second area A2 is sufficiently charged to (e.g., in) a pixel that is disposed at (e.g., in or on) the second area A2 and connected to the last horizontal line of the second area A2.

When each of the first display area DA1, the second display area DA2, and the third display area DA3 are activated (e.g., are in an active state) as shown in FIG. 15, the data voltage (e.g., the fourth data voltage VD4 shown in FIG. 17) that is transmitted to the last active line of the third display area DA3 has a first slew rate. When the first display area DA1 is activated (e.g., is in an active state) and each of the second display area DA2 and the third display area DA3 are inactivated (e.g., are in an inactive state) as shown in FIG. 21, the data voltage (e.g., the second data voltage VD2 shown in FIG. 23) that is transmitted to the last active line of the first display area DA1 has a third slew rate. The first slew rate of the data voltage (e.g., the fourth data voltage VD4 shown in FIG. 17) may be the same or substantially the same as the third slew rate of the data voltage (e.g., the second data voltage VD2 shown in FIG. 23). The waveform of the second data voltage VD2 shown in FIG. 23 may be the same or substantially the same as the waveform of the fourth data voltage VD4 shown in FIG. 17.

The third and fourth data voltages VD3 and VD4 shown in FIG. 23 may not be sufficiently charged to pixels at (e.g., in or on) the third and fourth areas A3 and A4. However, as shown in FIG. 21, the second and third display areas DA2 and DA3 are the inactive areas (e.g., areas displaying a black image) so that the display quality may not be deteriorated even though the third and fourth data voltages VD3 and VD4 shown in FIG. 23 are not sufficiently charged to the pixels at (e.g., in or on) the third and fourth areas A3 and A4.

Although not shown in figures, in various embodiments, when operating in the partial display mode, only the second display area DA2 from among the first, second, and third display areas DA1, DA2, and DA3 of the foldable display panel 100A of FIG. 13 may be activated (e.g., may be in an active state), only the third display area DA3 from among the first, second, and third display areas DA1, DA2, and DA3 of the foldable display panel 100A of FIG. 13 may be activated (e.g., may be in an active state), only the second and third display areas DA2 and DA3 from among the first, second, and third display areas DA1, DA2, and DA3 of the foldable display panel 100A of FIG. 13 may be activated (e.g., may be in an active state), and/or only the first and third display areas DA1 and DA3 from among the first, second, and third display areas DA1, DA2, and DA3 of the foldable display panel 100A of FIG. 13 may be activated (e.g., may be in an active state). In these cases, various aspects and features of the present inventive concept may be applied thereto. For example, in these cases, the driving current of the data driver 500 may be variously changed to a suitable or corresponding data voltage that is applied to a last horizontal line of an active display area such that the suitable or corresponding data voltage is sufficiently charged in a pixel that is connected to the last horizontal line of the active display area.

According to one or more exemplary embodiments of the present inventive concept, the data driver 500 is driven using different driving currents when operating in the normal display mode and in the partial driving mode, so that power consumption of the data driver 500 when operating in the partial driving mode may be reduced. For example, the driving current of the data driver 500 may be variously adjusted according to (e.g., depending on or based on) the position of the last horizontal line that is the farthest from the data driver at (e.g., in or on) the active display area where the image is displayed, so that the power consumption of the data driver 500 may be reduced.

Figure 24:
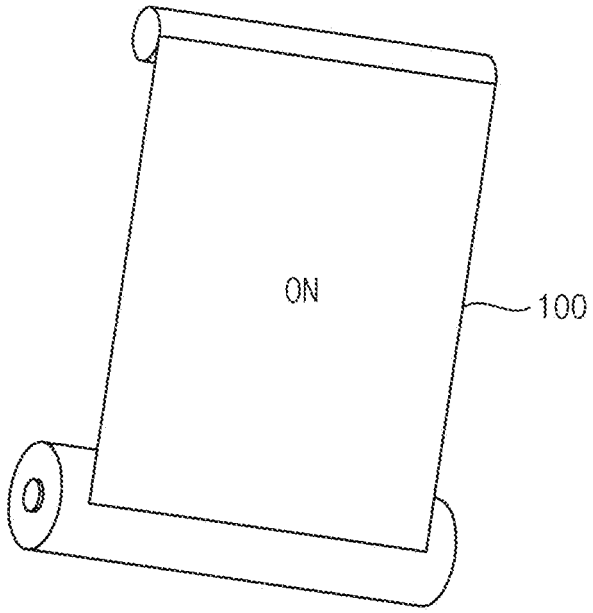
FIG. 24 is a perspective view illustrating a display apparatus according to an exemplary embodiment of the present inventive concept.
Figure 25:
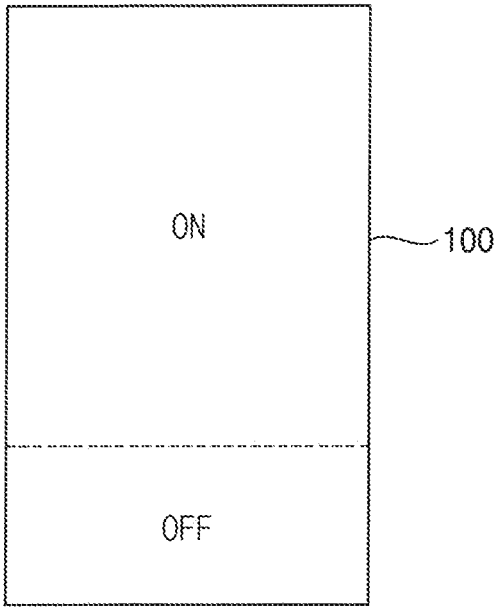
FIG. 25 is a plan view illustrating a display panel of FIG. 24.
Figure 26:
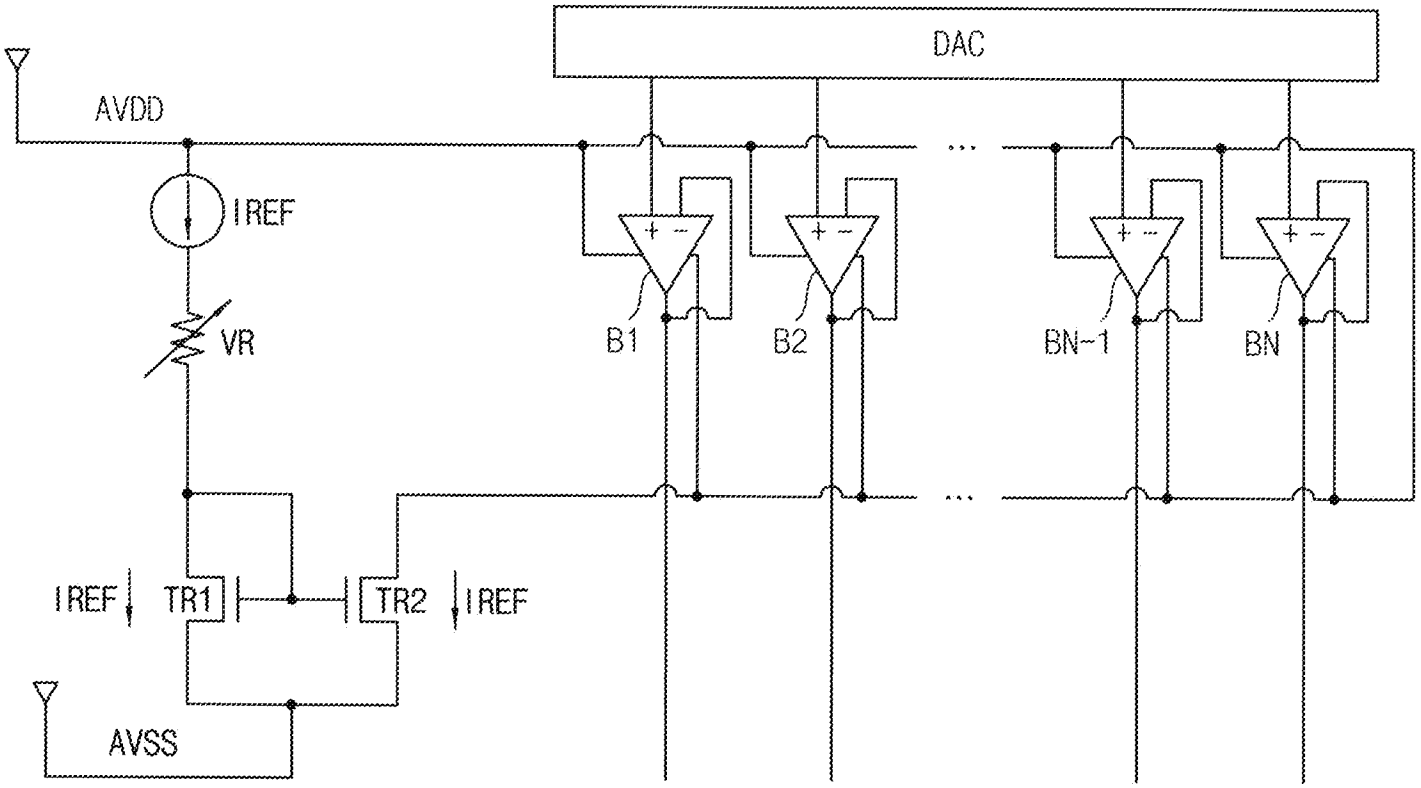
FIG. 26 is a circuit diagram illustrating a data driver of the display apparatus of FIG. 24.

FIG. 24 is a perspective view illustrating a display apparatus according to an exemplary embodiment of the present inventive concept. FIG. 25 is a plan view illustrating a display panel of FIG. 24. FIG. 26 is a circuit diagram illustrating a data driver of the display apparatus of FIG. 24.

The display apparatus and the method of driving the display apparatus according to the present exemplary embodiment is substantially the same as the display apparatus and the method of driving the display apparatus of the previous exemplary embodiment explained referring to FIGS. 1 to 12 except that the display apparatus is a rollable display apparatus. Thus, the same reference numerals will be used to refer to the same or like parts as those described in the previous exemplary embodiment of FIGS. 1 to 12 and any repetitive explanation concerning the above elements will be omitted.

Referring to FIGS. 3 and 24 to 26, the display apparatus includes a display panel 100 and a display panel driver. The display panel driver includes a driving controller 200, a gate driver 300, a gamma reference voltage generator 400, a data driver 500, and an emission driver 600.

The display apparatus may include a flexible display panel. The display apparatus may be a rollable display apparatus. When the display panel 100 is wound around an axis, a size of an active display area ON may decrease and a size of an inactive display area OFF may increase. In contrast, when the display panel 100 is unwound from the axis, the size of the active display area ON may increase and the size of the inactive display area OFF may decrease.

A slew rate of a driving current of the data driver 500 may be varied (or changed, or adjusted) according to the size of the active display area ON (or the display mode). For example, when the size of the active display area ON increases, the slew rate of the driving current may increase. The slew rate means a rate of a change of an output signal according to a change of an input signal. When the slew rate is relatively high, the driving current may be applied relatively fast. When the slew rate is relatively low, the driving current may be applied relatively slowly.

The data driver 500 may include a plurality of output buffers B1, B2, . . . , BN-1, and BN for outputting data voltages to corresponding data lines DL of the rollable display panel 100. The data driver 500 may further include a digital to analog converter DAC for providing the data voltages to the output buffers B1, B2, . . . , BN-1, and BN. The data driver 500 may further include a current mirror circuit that is connected (e.g., commonly connected) to the output buffers B1, B2, . . . , BN-1, and BN to provide a driving current to the output buffers B1, B2, . . . , BN-1, and BN.

In the present exemplary embodiment, the slew rate of the driving current of the data driver 500 may be controlled by a variable resistance VR of the current mirror circuit. For example, when the variable resistance VR increases, the slew rate of the driving current may decrease.

The current mirror circuit may include a current source for providing a reference current IREF, and the variable resistance VR connected to (e.g., connected in series with) the current source.

The current mirror circuit may further include a first transistor TR1 connected to the variable resistance VR and a second transistor TR2 connected to the first transistor TR1.

A first power voltage AVDD may be applied to the power source and a second power voltage AVSS may be applied to the first transistor TR1 and the second transistor TR2.

In FIG. 25, when the active display area ON increases, the variable resistance VR may be adjusted to be low so that the slew rate of the driving current IREF may increase. In contrast, when the active display area ON decreases, the variable resistance VR may be adjusted to be high so that the slew rate of the driving current IREF may decrease.

According to the present exemplary embodiment, the data driver 500 is driven using the different slew rates of the driving currents according to the size of the active display area ON of the rollable display apparatus so that power consumption of the data driver may be reduced when the size of the active display area ON is decreases.

Figure 27:
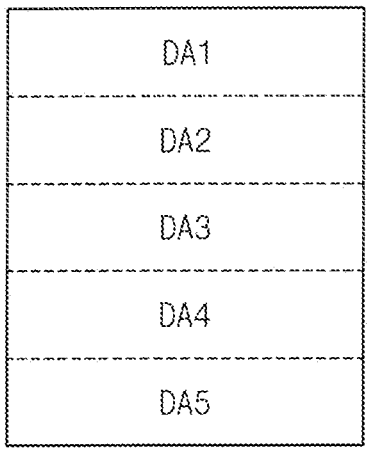
FIG. 27 is a plan view illustrating a display panel of a display apparatus according to an exemplary embodiment of the present inventive concept.
Figure 28:
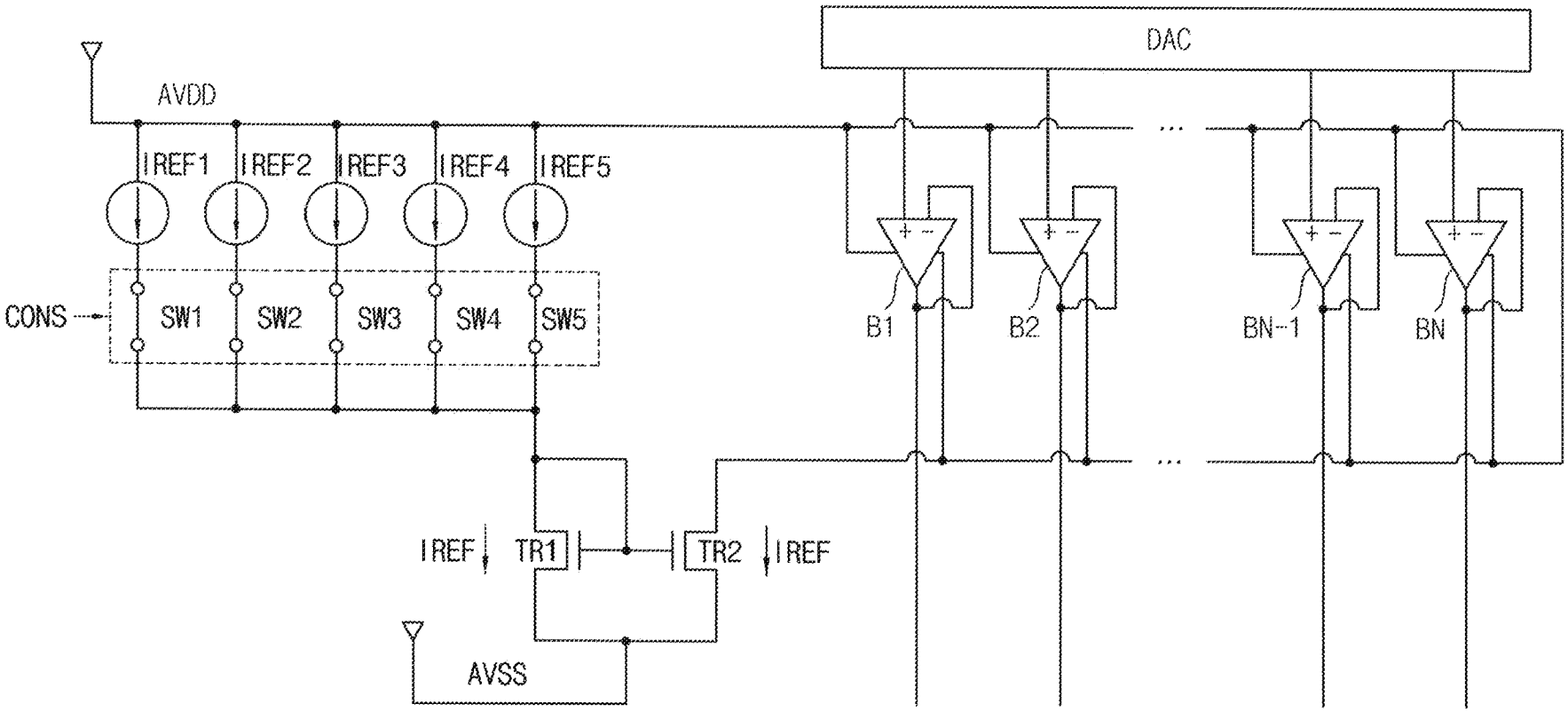
FIG. 28 is a circuit diagram illustrating a data driver of the display apparatus of FIG. 27.

FIG. 27 is a plan view illustrating a display panel of a display apparatus according to an exemplary embodiment of the present inventive concept. FIG. 28 is a circuit diagram illustrating a data driver of the display apparatus of FIG. 27.

The display apparatus and the method of driving the display apparatus according to the present exemplary embodiment is substantially the same as the display apparatus and the method of driving the display apparatus of the previous exemplary embodiment explained referring to FIGS. 24 to 26 except for the structure of the data driver. Thus, the same reference numerals will be used to refer to the same or like parts as those described in the previous exemplary embodiment of FIGS. 24 to 26 and any repetitive explanation concerning the above elements will be omitted.

Referring to FIGS. 3, 24, 27 and 28, the display apparatus includes a display panel 100 and a display panel driver. The display panel driver includes a driving controller 200, a gate driver 300, a gamma reference voltage generator 400, a data driver 500, and an emission driver 600.

The display apparatus may include a flexible display panel. The display apparatus may be a rollable display apparatus. When the display panel 100 is wound around an axis, a size of an active display area ON may decrease and a size of an inactive display area OFF may increase. In contrast, when the display panel 100 is unwound from the axis, the size of the active display area ON may increase and the size of the inactive display area OFF may decrease.

A driving current of the data driver 500 may be varied (or changed, or adjusted) according to the size of the active display area ON (or the display mode). For example, when the size of the active display area ON increases, the driving current may increase.

As shown in FIG. 27, the display panel 100 may be divided into a plurality of display areas (e.g. DA1 to DA5). Although the display panel 100 is divided into five display areas DA1 to DA5 in the present exemplary embodiment, the present inventive concept may not be limited to the number of the display areas.

The data driver 500 may include a plurality of output buffers B1, B2, . . . , BN-1, and BN for outputting data voltages to corresponding data lines DL of the rollable display panel 100. The data driver 500 may further include a digital to analog converter DAC for providing the data voltages to the output buffers B1, B2, . . . , BN-1, and BN. The data driver 500 may further include a current mirror circuit that is connected (e.g., commonly connected) to the output buffers B1, B2, . . . , BN-1, and BN to provide a driving current to the output buffers B1, B2, . . . , BN-1, and BN.

A driving current of the data driver 500 may be varied (or changed, or adjusted) according to the size of the active display area ON. For example, when the size of the active display area ON increases, the driving current may increase. For example, when the size of the active display area ON decreases, the driving current may decrease.

The current mirror circuit may include a plurality of current sources IREF1 to IREF5, a plurality of switches SW1 to SW5 respectively connected to the current sources IREF1 to IREF5 in series. When the size of the active display area ON increases, the number of turned-on switches among all of the switches SW1 to SW5 may increase.

The current mirror circuit of the data driver 500 may include a first current source providing a first reference current IREF1, a first switch SW1 connected to the first current source in series, a second current source providing a second reference current IREF2, a second switch SW2 connected to the second current source in series, a third current source providing a third reference current IREF3, a third switch SW3 connected to the third current source in series, a fourth current source providing a fourth reference current IREF4, a fourth switch SW4 connected to the fourth current source in series, a fifth current source providing a fifth reference current IREF5 and a fifth switch SW5 connected to the fifth current source in series. The first switch SW1, the second switch SW2, the third switch SW3, the fourth switch SW4 and the fifth switch SW5 may be connected in parallel. The first to fifth switches SW1 to SW5 may be controlled by a switching control signal CONS determined according to the size of the active display area.

In FIG. 27, when all of the first to fifth display areas DA1 to DA5 are activated, all of the first to fifth switches SW1 to SW5 in FIG. 28 may be turned on. The data driver 500 may be driven according to the driving current (e.g., IREF=IREF1+IREF2+IREF3+IREF4+IREF5) corresponding to a sum of the first reference current IREF1 that is applied through the first switch SW1, the second reference current IREF2 that is applied through the second switch SW2, the third reference current IREF3 that is applied through the third switch SW3 the fourth reference current IREF4 that is applied through the fourth switch SW4 and the fifth reference current IREF5 that is applied through the fifth switch SW5.

In FIG. 27, when some of the first to fifth display areas DA1 to DA5 are activated, some of the first to fifth switches SW1 to SW5 in FIG. 28 may be turned on.

According to the present exemplary embodiment, the data driver 500 is driven using the different driving currents according to the size of the active display area ON of the rollable display apparatus so that power consumption of the data driver may be reduced when the size of the active display area ON is decreases.

Figure 29:
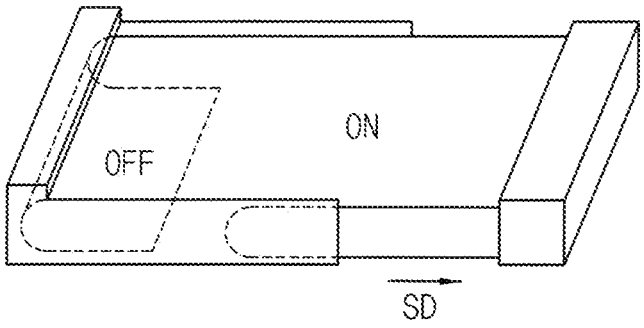
FIG. 29 is a perspective view illustrating a display apparatus according to an exemplary embodiment of the present inventive concept.
Figure 30:
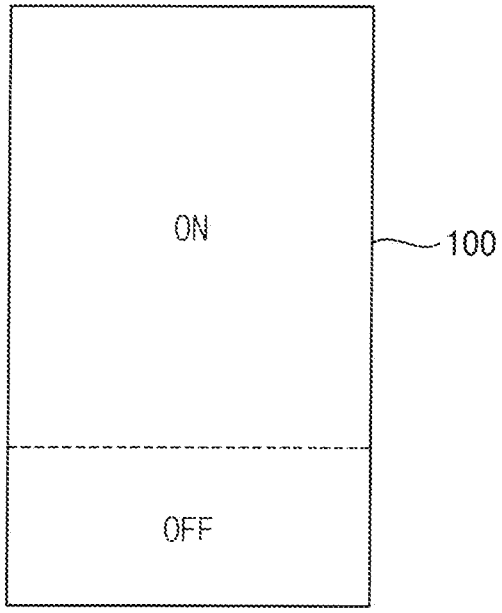
FIG. 30 is a plan view illustrating a display panel of FIG. 29.
Figure 31:
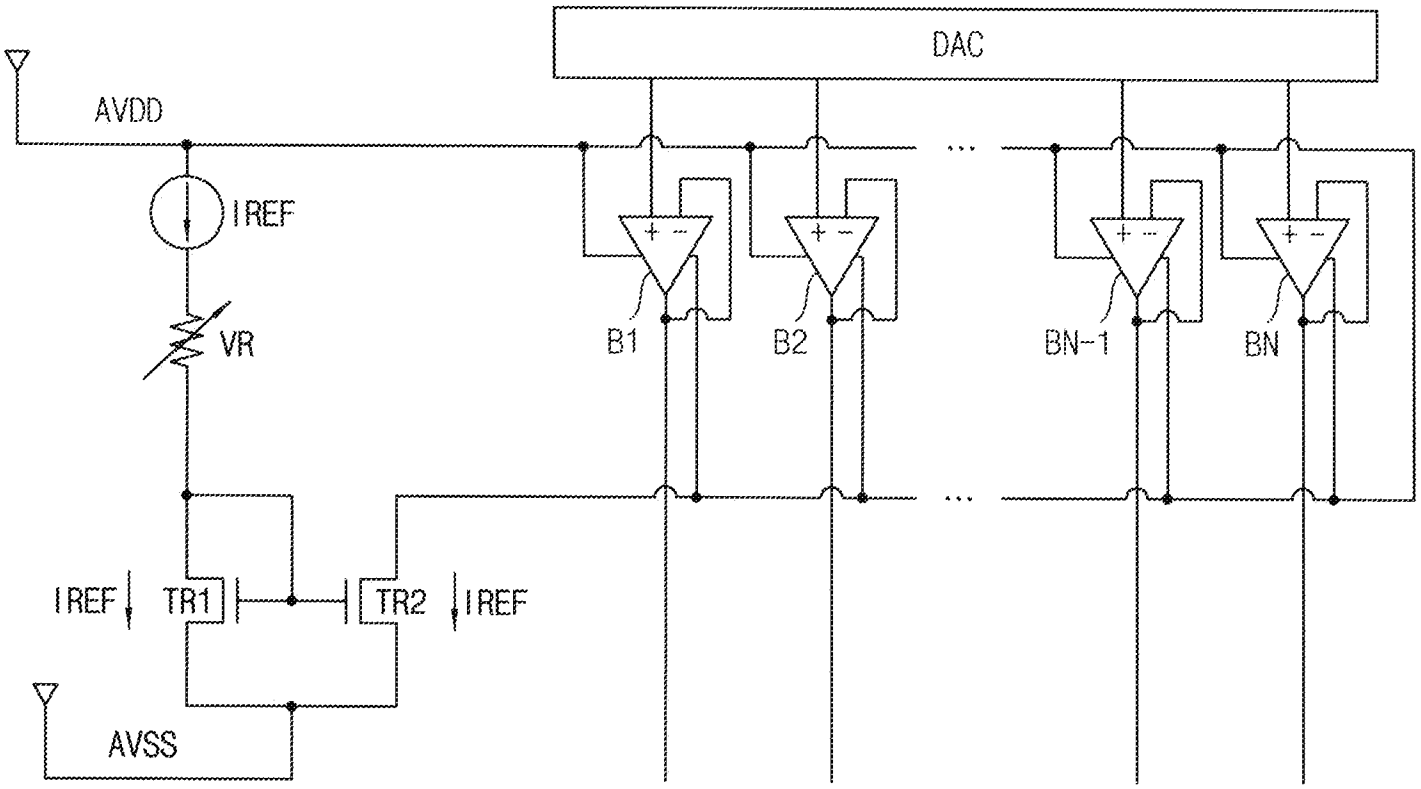
FIG. 31 is a circuit diagram illustrating an example of a data driver of the display apparatus of FIG. 29.

FIG. 29 is a perspective view illustrating a display apparatus according to an exemplary embodiment of the present inventive concept. FIG. 30 is a plan view illustrating a display panel of FIG. 29. FIG. 31 is a circuit diagram illustrating an example of a data driver of the display apparatus of FIG. 29.

The display apparatus and the method of driving the display apparatus according to the present exemplary embodiment is substantially the same as the display apparatus and the method of driving the display apparatus of the previous exemplary embodiment explained referring to FIGS. 1 to 12 except that the display apparatus is a slide display apparatus. Thus, the same reference numerals will be used to refer to the same or like parts as those described in the previous exemplary embodiment of FIGS. 1 to 12 and any repetitive explanation concerning the above elements will be omitted.

Referring to FIGS. 3 and 29 to 31, the display apparatus includes a display panel 100 and a display panel driver. The display panel driver includes a driving controller 200, a gate driver 300, a gamma reference voltage generator 400, a data driver 500, and an emission driver 600.

The display apparatus may include a flexible display panel. The display apparatus may be a slide display apparatus. When the display panel 100 is pulled in a slide direction SD, a size of an active display area ON may increase and a size of an inactive display area OFF may decrease. In contrast, when the display panel 100 is pushed in a direction opposite to the slide direction SD, the size of the active display area ON may decrease and the size of the inactive display area OFF may increase.

A slew rate of a driving current of the data driver 500 may be varied (or changed, or adjusted) according to the size of the active display area ON (or the display mode). For example, when the size of the active display area ON increases, the slew rate of the driving current may increase. The slew rate means a rate of a change of an output signal according to a change of an input signal. When the slew rate is relatively high, the driving current may be applied relatively fast. When the slew rate is relatively low, the driving current may be applied relatively slowly.

The data driver 500 may include a plurality of output buffers B1, B2, . . . , BN-1, and BN for outputting data voltages to corresponding data lines DL of the slide display panel 100. The data driver 500 may further include a digital to analog converter DAC for providing the data voltages to the output buffers B1, B2, . . . , BN-1, and BN. The data driver 500 may further include a current mirror circuit that is connected (e.g., commonly connected) to the output buffers B1, B2, . . . , BN-1, and BN to provide a driving current to the output buffers B1, B2, . . . , BN-1, and BN.

In the present exemplary embodiment, the slew rate of the driving current of the data driver 500 may be controlled by a variable resistance VR of the current mirror circuit. For example, when the variable resistance VR increases, the slew rate of the driving current may decrease.

The current mirror circuit may include a current source for providing a reference current IREF, and the variable resistance VR connected to (e.g., connected in series with) the current source.

The current mirror circuit may further include a first transistor TR1 connected to the variable resistance VR and a second transistor TR2 connected to the first transistor TR1.

A first power voltage AVDD may be applied to the power source and a second power voltage AVSS may be applied to the first transistor TR1 and the second transistor TR2.

In FIG. 30, when the active display area ON increases, the variable resistance VR may be adjusted to be low so that the slew rate of the driving current IREF may increase. In contrast, when the active display area ON decreases, the variable resistance VR may be adjusted to be high so that the slew rate of the driving current IREF may decrease.

According to the present exemplary embodiment, the data driver 500 is driven using the different slew rates of the driving currents according to the size of the active display area ON of the slide display apparatus so that power consumption of the data driver may be reduced when the size of the active display area ON is decreases.

Figure 32:
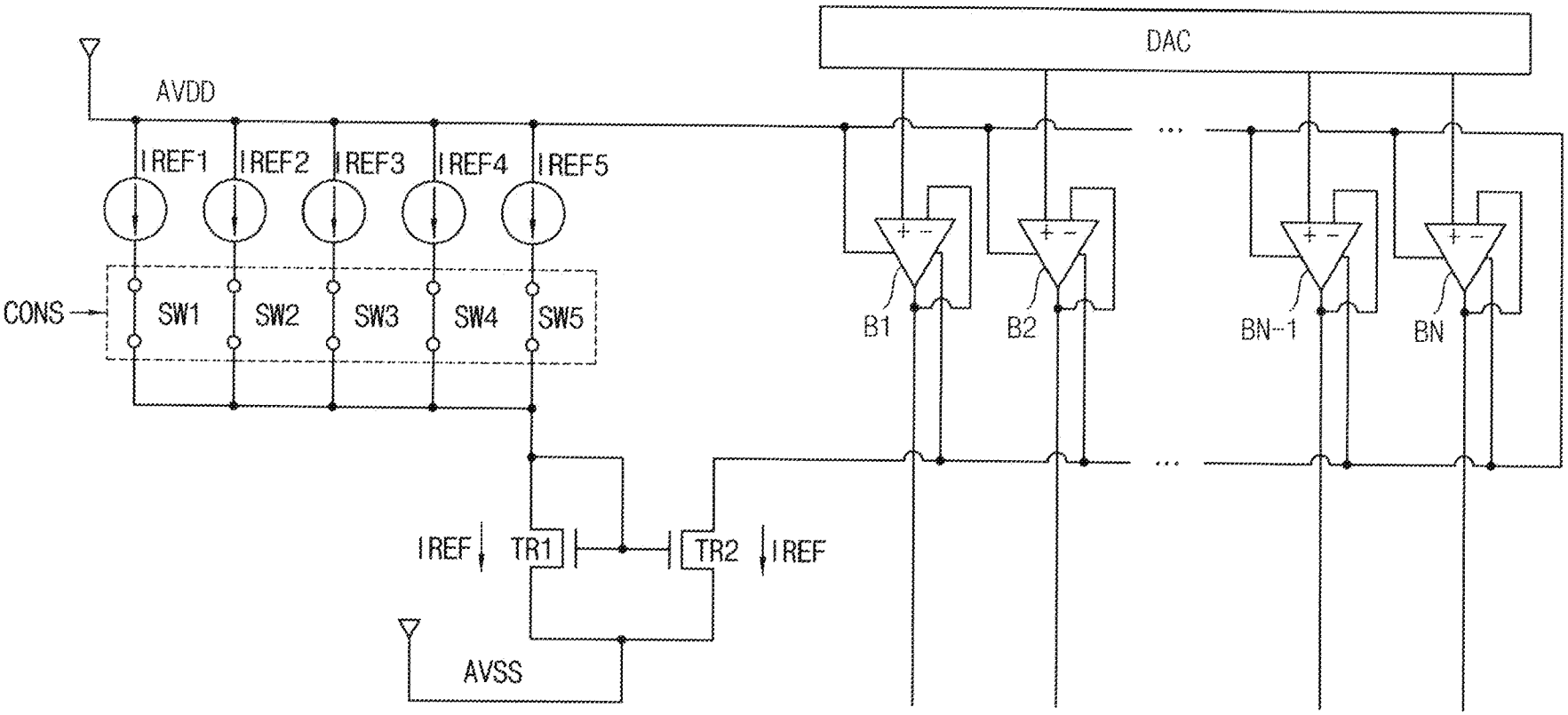
FIG. 32 is a circuit diagram illustrating an example of a data driver of the display apparatus of FIG. 29.

FIG. 32 is a circuit diagram illustrating an example of a data driver of the display apparatus of FIG. 29.

The display apparatus and the method of driving the display apparatus according to the present exemplary embodiment is substantially the same as the display apparatus and the method of driving the display apparatus of the previous exemplary embodiment explained referring to FIGS. 29 to 31 except for the structure of the data driver. Thus, the same reference numerals will be used to refer to the same or like parts as those described in the previous exemplary embodiment of FIGS. 29 to 31 and any repetitive explanation concerning the above elements will be omitted.

Referring to FIGS. 3, 27, 29 and 32, the display apparatus includes a display panel 100 and a display panel driver. The display panel driver includes a driving controller 200, a gate driver 300, a gamma reference voltage generator 400, a data driver 500, and an emission driver 600.

The display apparatus may include a flexible display panel. The display apparatus may be a slide display apparatus. When the display panel 100 is pulled in a slide direction SD, a size of an active display area ON may increase and a size of an inactive display area OFF may decrease. In contrast, when the display panel 100 is pushed in an opposite direction of the slide direction SD, the size of the active display area ON may decrease and the size of the inactive display area OFF may increase.

A driving current of the data driver 500 may be varied (or changed, or adjusted) according to the size of the active display area ON (or the display mode). For example, when the size of the active display area ON increases, the driving current may increase.

As shown in FIG. 27, the display panel 100 may be divided into a plurality of display areas (e.g. DA1 to DA5). Although the display panel 100 is divided into five display areas DA1 to DA5 in the present exemplary embodiment, the present inventive concept may not be limited to the number of the display areas.

The data driver 500 may include a plurality of output buffers B1, B2, . . . , BN-1, and BN for outputting data voltages to corresponding data lines DL of the slide display panel 100. The data driver 500 may further include a digital to analog converter DAC for providing the data voltages to the output buffers B1, B2, . . . , BN-1, and BN. The data driver 500 may further include a current mirror circuit that is connected (e.g., commonly connected) to the output buffers B1, B2, . . . , BN-1, and BN to provide a driving current to the output buffers B1, B2, . . . , BN-1, and BN.

A driving current of the data driver 500 may be varied (or changed, or adjusted) according to the size of the active display area ON. For example, when the size of the active display area ON increases, the driving current may increase. For example, when the size of the active display area ON decreases, the driving current may decrease.

The current mirror circuit may include a plurality of current sources IREF1 to IREF5, a plurality of switches SW1 to SW5 respectively connected to the current sources IREF1 to IREF5 in series. When the size of the active display area ON increases, the number of turned-on switches among all of the switches SW1 to SW5 may increase.

The current mirror circuit of the data driver 500 may include a first current source providing a first reference current IREF1, a first switch SW1 connected to the first current source in series, a second current source providing a second reference current IREF2, a second switch SW2 connected to the second current source in series, a third current source providing a third reference current IREF3, a third switch SW3 connected to the third current source in series, a fourth current source providing a fourth reference current IREF4, a fourth switch SW4 connected to the fourth current source in series, a fifth current source providing a fifth reference current IREF5 and a fifth switch SW5 connected to the fifth current source in series. The first switch SW1, the second switch SW2, the third switch SW3, the fourth switch SW4 and the fifth switch SW5 may be connected in parallel. The first to fifth switches SW1 to SW5 may be controlled by a switching control signal CONS determined according to the size of the active display area.

In FIG. 27, when all of the first to fifth display areas DA1 to DA5 are activated, all of the first to fifth switches SW1 to SW5 in FIG. 28 may be turned on. The data driver 500 may be driven according to the driving current (e.g., IREF=IREF1+IREF2+IREF3+IREF4+IREF5) corresponding to a sum of the first reference current IREF1 that is applied through the first switch SW1, the second reference current IREF2 that is applied through the second switch SW2, the third reference current IREF3 that is applied through the third switch SW3 the fourth reference current IREF4 that is applied through the fourth switch SW4 and the fifth reference current IREF5 that is applied through the fifth switch SW5.

In FIG. 27, when some of the first to fifth display areas DA1 to DA5 are activated, some of the first to fifth switches SW1 to SW5 in FIG. 28 may be turned on.

According to the present exemplary embodiment, the data driver 500 is driven using the different driving currents according to the size of the active display area ON of the slide display apparatus so that power consumption of the data driver may be reduced when the size of the active display area ON is decreases.

According to one or more exemplary embodiments of the present inventive concept as described above, the power consumption of the foldable display apparatus, the rollable display apparatus and the slide display apparatus may be reduced.

However, the foregoing is illustrative of exemplary embodiments of the present inventive concept, and is not to be construed as being limited to the aspects and features described herein. Accordingly, while a few exemplary embodiments of the present inventive concept have been described, those skilled in the art will readily appreciate that various modifications may be possible in the exemplary embodiments without departing from the spirit and scope of the present inventive concept.

In the following claims, means-plus-function clauses, if any, are intended to cover the structures described herein as performing the recited function, and not only structural equivalents but also equivalent structures. Therefore, it is to be understood that the foregoing is illustrative of the present inventive concept and is not to be construed as being limited to the exemplary embodiments described herein, such that various modifications to the disclosed exemplary embodiments, as well as other exemplary embodiments, are intended to be included within the scope and scope of the appended claims. Accordingly, all such modifications are intended to be included within the spirit and scope of the present inventive concept, as defined in the following claims, and their equivalents.

What is claimed is:

1. A display apparatus comprising:

a foldable display panel configured to display an image;

a gate driver configured to output a gate signal to the foldable display panel; and a data driver configured to output a data voltage to of the foldable display panel according to a driving current, and the driving current to change according to a display mode that corresponds to a folded state of the foldable display panel, wherein the driving current of the data driver is determined according to an active line that is farthest from the data driver at an active display area of the foldable display panel where the image is to be displayed.

2. The display apparatus of claim 1, wherein:

the display mode comprises a normal display mode and a partial display mode;

the driving current comprises a first driving current and a second driving current;

the data driver is configured to be driven by the first driving current in the normal display mode to display the image on an entirety of a display area of the foldable display panel when operating in the normal display mode;

the data driver is configured to be driven by the second driving current in the partial display mode to display the image on a portion of the display area of the foldable display panel when operating in the partial display mode; and the first driving current is greater than the second driving current.

3. The display apparatus of claim 2, wherein the data driver comprises a plurality of output buffers configured to output the data voltage to a plurality of data lines of the foldable display panel, and wherein the driving current of the data driver corresponds to a driving current of the output buffers.

4. The display apparatus of claim 3, wherein the data driver comprises a current mirror circuit connected to each of the output buffers, the current mirror circuit comprising:

a first current source;

a first switch connected to the first current source in series;

a second current source; and a second switch connected to the second current source in series, wherein each of the first switch and the second switch are configured to be turned on in the normal display mode, and wherein the first switch is configured to be turned off and the second switch is configured to be turned on in the partial display mode.

5. The display apparatus of claim 1, wherein:

the foldable display panel comprises a first display area and a second display area;

the first display area is closer to the data driver than the second display area;

the driving current comprises a first driving current and a second driving current;

the data driver is configured to be driven by the first driving current when each of the first display area and the second display area is in an active state;

the data driver is configured to be driven by the second driving current when the first display area is in an active state and the second display area is in an inactive state; and the first driving current is greater than the second driving current.

6. The display apparatus of claim 5, wherein the data driver comprises a current mirror circuit connected to each of a plurality of output buffers, the current mirror circuit comprising:

a first current source;

a first switch connected to the first current source in series;

a second current source; and a second switch connected to the second current source in series, wherein each of the first switch and the second switch is configured to be turned on when each of the first display area and the second display area is in an active state, and wherein the first switch is configured to be turned off and the second switch is configured to be turned on when the first display area is in an active state and the second display area is in an inactive state.

7. The display apparatus of claim 5, wherein a data voltage that is transmitted to a last active line of the second display area has a first slew rate when each of the first display area and the second display area is in an active state, wherein a data voltage that is transmitted to a last active line of the first display area has a second slew rate when the first display area is in an active state and the second display area is in an inactive state, and wherein the first slew rate is substantially the same as the second slew rate.

8. The display apparatus of claim 1, wherein:

the foldable display panel comprises a first display area and a second display area;

the first display area is closer to the data driver than the second display area;

the driving current comprises a first driving current and a third driving current;

the data driver is configured to be driven by the first driving current when each of the first display area and the second display area is in an active state;

the data driver is configured to be driven by the third driving current when the first display area is in an inactive state and the second display area is in an active state; and the first driving current is substantially equal to the third driving current.

9. The display apparatus of claim 1, wherein:

the foldable display panel comprises a first display area, a second display area, and a third display area;

the first display area is closer to the data driver than the second display area;

the second display area is closer to the data driver than the third display area;

the driving current comprises a first driving current and a second driving current;

the data driver is configured to be driven by the first driving current when each of the first display area, the second display area, and the third display area is in an active state;

the data driver is configured to be driven by the second driving current when each of the first display area and the second display area is in an active state, and the third display area is in an inactive state; and the first driving current is greater than the second driving current.

10. The display apparatus of claim 9, wherein the data driver comprises a current mirror circuit connected to each of a plurality of output buffers, the current mirror circuit comprising:

a first current source;

a first switch connected to the first current source in series;

a second current source;

a second switch connected to the second current source in series;

a third current source; and a third switch connected to the third current source in series, wherein each of the first switch, the second switch, and the third switch are configured to be turned on when each of the first display area, the second display area, and the third display area is in an active state, and wherein the first switch is configured to be turned off and each of the second switch and the third switch are configured to be turned on when each of the first display area and the second display area is in an active state, and the third display area is in an inactive state.

11. The display apparatus of claim 9, wherein:

a data voltage that is transmitted to a last active line of the third display area has a first slew rate when each of the first display area, the second display area, and the third display area is in an active state;

a data voltage that is transmitted to a last active line of the second display area has a second slew rate when each of the first display area and the second display area is in an active state, and the third display area is in an inactive state; and the first slew rate is substantially the same as the second slew rate.

12. The display apparatus of claim 9, wherein:

the driving current further comprises a third driving current;

the data driver is configured to be driven by the third driving current when the first display area is in an active state, and each of the second display area and the third display area is in an inactive state; and the second driving current is greater than the third driving current.

13. The display apparatus of claim 12, wherein the data driver comprises a current mirror circuit connected to each of a plurality of output buffers, the current mirror circuit comprising:

a first current source;

a first switch connected to the first current source in series;

a second current source;

a second switch connected to the second current source in series;

a third current source; and a third switch connected to the third current source in series, and wherein each of the first switch and the second switch are configured to be turned off and the third switch is configured to be turned on when the first display area is in an active state and each of the second display area and the third display area is in an inactive state.

14. The display apparatus of claim 12, wherein:

a data voltage that is transmitted to a last active line of the third display area has a first slew rate when each of the first display area, the second display area, and the third display area is in an active state;

a data voltage that is transmitted to a last active line of the first display area has a third slew rate when the first display area is in an active state and each of the second display area and the third display area is in an inactive state; and the first slew rate is substantially the same as the third slew rate.

15. A method of driving a display apparatus, the method comprising:

outputting a gate signal to a foldable display panel;

adjusting a driving current of a data driver according to a display mode, the display mode corresponding to a folded state of the foldable display panel; and outputting a data voltage to the foldable display panel according to the driving current of the data driver, wherein the driving current of the data driver is determined according to an active line that is farthest from the data driver at an active display area of the foldable display panel where an image is displayed.

16. The method of claim 15, wherein:

the display mode comprises a normal display mode and a partial display mode;

the driving current comprises a first driving current and a second driving current;

the data driver is configured to be driven by the first driving current in the normal display mode to display an image on an entirety of a display area of the foldable display panel when operating in the normal display mode;

the data driver is configured to be driven by the second driving current in the partial display mode to display the image on a portion of the display area of the foldable display panel when operating in the partial display mode; and the first driving current is greater than the second driving current.

17. The method of claim 16, wherein the data driver comprises a plurality of output buffers configured to output the data voltage to a plurality of data lines of the foldable display panel, and wherein the driving current of the data driver corresponds to a driving current of the output buffers.

18. The method of claim 17, wherein the data driver comprises a current mirror circuit connected to each of the output buffers, the current mirror circuit comprising:

a first current source;

a first switch connected to the first current source in series;

a second current source; and a second switch connected to the second current source in series, wherein each of the first switch and the second switch are configured to be turned on when in the normal display mode, and wherein the first switch is configured to be turned off and the second switch is configured to be turned on when in the partial display mode.

19. A display apparatus comprising:

a display panel configured to display an image;

a gate driver configured to output a gate signal to the display panel; and a data driver configured to output a data voltage to the display panel according to a driving current, the driving current to change according to a size of an active display area of the display panel, wherein a slew rate of the driving current is changed as the size of the active display area of the display panel is changed.

20. The display apparatus of claim 19, wherein the display panel is a foldable display panel, wherein the size of the active display area decreases when the display panel is folded along a folding line, and wherein the size of the active display area increases when the display panel is unfolded.

21. The display apparatus of claim 19, wherein the display panel is a rollable display panel, wherein the size of the active display area decreases when the display panel is wound around an axis, and wherein the size of the active display area increases when the display panel is unwound from the axis.

22. The display apparatus of claim 19, wherein the display panel is a slide display panel, wherein the size of the active display area increases when the display panel is pulled in a sliding direction, and wherein the size of the active display area decreases when the display panel is pushed in a direction opposite to the sliding direction.

23. The display apparatus of claim 19, wherein when the size of the active display area increases, the slew rate of the driving current increases.

24. The display apparatus of claim 23, wherein the data driver includes a plurality of output buffers configured to output data voltages to corresponding data lines of the display panel, wherein the driving current of the data driver corresponds to a driving current of the output buffers wherein the data driver includes a current mirror circuit commonly connected to the output buffers, wherein the current mirror circuit includes a current source and a variable resistance connected to the current mirror circuit in series, and wherein when the size of the active display area increases, the variable resistance decreases.

25. The display apparatus of claim 19, wherein when the size of the active display area increases, the driving current increases.

26. The display apparatus of claim 25, wherein the data driver includes a plurality of output buffers configured to output data voltages to corresponding data lines of the display panel, wherein the driving current of the data driver corresponds to a driving current of the output buffers wherein the data driver includes a current mirror circuit commonly connected to the output buffers, wherein the current mirror circuit includes a plurality of current sources and a plurality of switches respectively connected to the current sources in series, and wherein when the size of the active display area increases, the number of turned on switches among the plurality of switches increases.

* * * * *